US009936851B2

(12) United States Patent
Kim et al.

(10) Patent No.: US 9,936,851 B2
(45) Date of Patent: Apr. 10, 2018

(54) DISHWASHING MACHINE

(71) Applicant: LG ELECTRONICS INC., Seoul (KR)

(72) Inventors: Daegyu Kim, Seoul (KR); Byeonghyeon Ju, Seoul (KR); Younghwan Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 40 days.

(21) Appl. No.: 14/024,662

(22) Filed: Sep. 12, 2013

(65) Prior Publication Data

US 2014/0083470 A1 Mar. 27, 2014

(30) Foreign Application Priority Data

Sep. 25, 2012 (KR) ..... 10-2012-0106356

(51) Int. Cl.
*A47L 15/23* (2006.01)
*A47L 15/42* (2006.01)

(52) U.S. Cl.
CPC ..... *A47L 15/23* (2013.01); *A47L 15/428* (2013.01); *A47L 15/4282* (2013.01)

(58) Field of Classification Search
CPC ..... A47L 15/23; A47L 15/4282; A47L 15/16; A47L 15/4246; A47L 15/4221; A47L 15/428; A47L 15/18; A47L 15/4251; A47L 15/06; A47L 15/4278; A47L 15/22; A47L 15/20; B08B 3/02; B08B 3/04; B08B 3/00; B08B 3/08; B08B 3/024; B08B 9/0321; B08B 9/0936; B08B 15/04; B08B 5/02; B08B 5/04
USPC ..... 134/183, 33, 200, 34, 148, 198, 167 R, 134/172, 58 D, 103.2, 131, 179, 22.18, 134/56 D, 57 D, 119, 129, 170, 184, 188, 134/22.12, 88, 94.1, 99.1, 99.2
See application file for complete search history.

(56) References Cited

U.S. PATENT DOCUMENTS 3,030,032 A 4/1962 Luhman, Jr.
3,292,645 A 12/1966 Braden et al.
(Continued)

FOREIGN PATENT DOCUMENTS

CA 2 694 426 8/2010
CN 1324272 11/2001
(Continued)

OTHER PUBLICATIONS

Chinese Office Action dated Sep. 2, 2015.
Chinese Office Action dated May 19, 2016 (Translation).
European Search Report dated Jun. 1, 2016.

*Primary Examiner* — Michael E Barr
*Assistant Examiner* — Tinsae B Ayalew
(74) *Attorney, Agent, or Firm* — KED & Associates, LLP

(57) ABSTRACT

A dishwashing machine is provided. The dishwashing machine may include a rack disposed in a tub to provide a washing space to receive objects to be washed, a water supply pump to supply wash water, a nozzle body disposed at an upper side of the rack to receive the wash water from the water supply pump, a discharge hole provided at the nozzle body to discharge the wash water supplied to the nozzle body to the rack, and an asymmetric impeller rotatably provided at the nozzle body to supply the wash water discharged from the discharge hole to at least two divided areas of the rack.

19 Claims, 16 Drawing Sheets

(56) References Cited

U.S. PATENT DOCUMENTS

| | | | | |
|---|---|---|---|---|
| 3,610,532 | A * | 10/1971 | Modrey | 239/251 |
| 3,809,106 | A | 5/1974 | Crabtree | |
| 7,717,361 | B2 * | 5/2010 | Nelson et al. | 239/222.17 |
| 2005/0178414 | A1 * | 8/2005 | Kang | 134/176 |
| 2005/0230502 | A1 | 10/2005 | Bragg et al. | |
| 2006/0032945 | A1 * | 2/2006 | Clearman | B05B 1/185<br>239/461 |
| 2010/0116301 | A1 * | 5/2010 | Heisele | B05B 3/0486<br>134/172 |

FOREIGN PATENT DOCUMENTS

| | | |
|---|---|---|
| CN | 1484724 | 3/2004 |
| CN | 101103892 | 1/2008 |
| CN | 101646377 | 2/2010 |
| CN | 201505114 | 6/2010 |
| DE | 10 2007 017 114 | 10/2008 |
| EP | 1232720 | 8/2002 |
| EP | 1 894 633 | 3/2008 |
| IL | 86226 | 12/1992 |

* cited by examiner

A1: A2 : A3 : A4 = 9: 16 : 24 : 32 ≒ 1: 2 : 3 : 4

| L1 | L2 | L3 | Angle of inclined surface |
|---|---|---|---|
| 9mm | 11mm | 19 ~ 20mm | ± 5° |

| | | | | | | | | |
|---|---|---|---|---|---|---|---|---|
| 7 | 19 | 29 | 22 | 18 | 21 | 17 | 8 | 4 |
| 22 | 63 | 47 | 33 | 29 | 22 | 54 | 21 | 7 |
| 58 | 24 | 32 | 29 | 76 | 23 | 36 | 53 | 15 |
| 42 | 15 | 48 | 15 | 13 | 16 | 40 | 29 | 32 |
| 49 | 18 | 55 | 38 | 100 | 46 | 62 | 20 | 64 |
| 58 | 22 | 28 | 85 | 72 | 88 | 30 | 25 | 36 |
| 28 | 62 | 16 | 21 | 58 | 27 | 20 | 55 | 21 |
| 11 | 31 | 69 | 38 | 49 | 38 | 56 | 38 | 13 |
| 6 | 10 | 21 | 43 | 46 | 45 | 30 | 16 | 7 |

| | | | | | | | | |
|---|---|---|---|---|---|---|---|---|
| 11 | 31 | 57 | 31 | 9 | 27 | 23 | 12 | 5 |
| 22 | 46 | 44 | 30 | 62 | 20 | 50 | 26 | 7 |
| 61 | 25 | 25 | 52 | 76 | 25 | 32 | 49 | 18 |
| 46 | 18 | 50 | 23 | 36 | 17 | 37 | 24 | 41 |
| 47 | 15 | 59 | 50 | 100 | 46 | 56 | 10 | 49 |
| 46 | 20 | 24 | 77 | 50 | 66 | 31 | 23 | 40 |
| 18 | 50 | 13 | 23 | 48 | 31 | 24 | 50 | 23 |
| 7 | 27 | 66 | 47 | 49 | 35 | 57 | 31 | 12 |
| 5 | 9 | 9 | 35 | 41 | 44 | 25 | 12 | 5 |

DISHWASHING MACHINE

CROSS-REFERENCE TO RELATED APPLICATION(S)

This application claims priority to Korean Patent Application No. 10-2012-0106356, filed in Korea on Sep. 25, 2012, which is hereby incorporated by reference as if fully set forth herein.

BACKGROUND

1. Field

A dishwashing machine is disclosed herein.

2. Background

Generally, a dishwashing machine receives objects to be washed in a washing space, and removes residue from the objects using wash water to clean the objects. In certain circumstances, such a dishwashing machine may also dry the objects.

BRIEF DESCRIPTION OF THE DRAWINGS

Embodiments will be described in detail with reference to the following drawings in which like reference numerals refer to like elements, and wherein.

DETAILED DESCRIPTION

Figure 1:
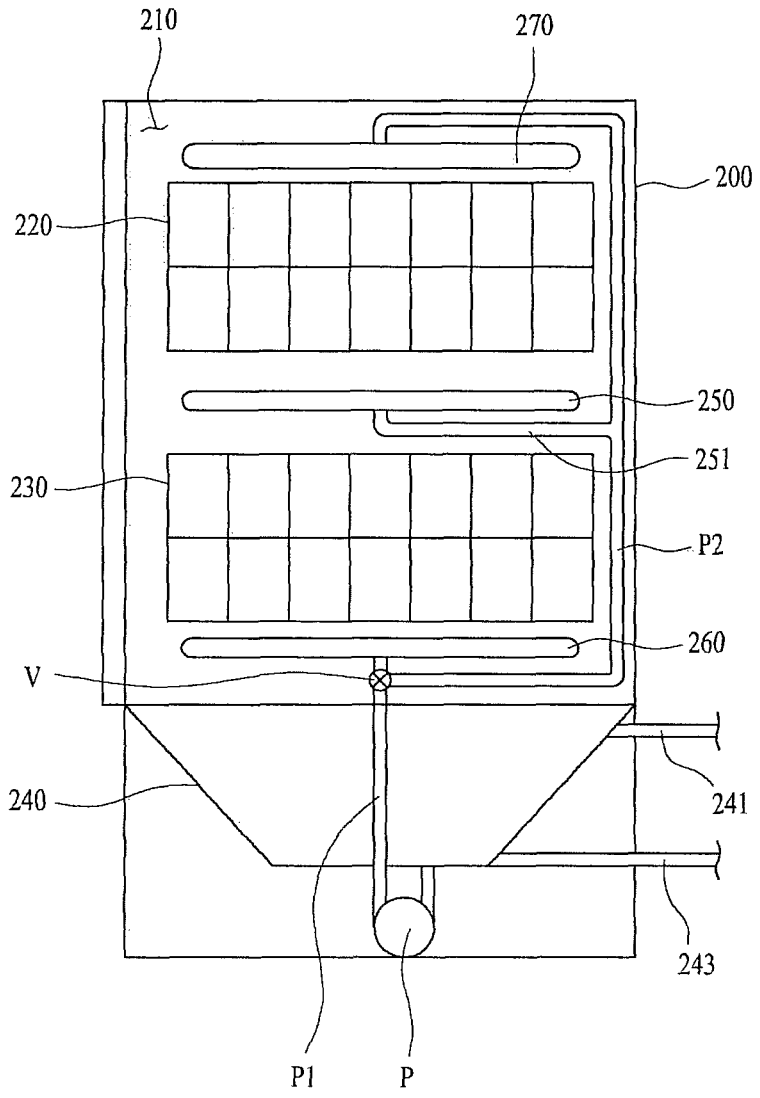
FIG. 1 is a schematic view of an exemplary dishwashing machine.

Reference will now be made in detail to various embodiments, examples of which are illustrated in the accompanying drawings. Where possible, like reference numerals have been used to indicate like elements and repetitive disclosure has been omitted.

FIG. 1 is a schematic diagram of an exemplary dishwashing machine. The dishwashing machine may include a cabinet 200 having a tub 210 to provide a washing space, an upper rack 220 and a lower rack 230 provided in the tub 210 to receive objects to be washed, a sump 240 disposed below the tub 210 to store wash water 240, a first arm 250 to spray wash water to the upper rack 220, a second arm 260 to spray wash water to the lower rack 230, a pump P to supply the wash water stored in the sump 240 to the second arm 260 through a first channel P1, and a second channel P2 diverged from the first channel P1 (or directly connected to the pump P) to supply wash water to the first arm 250. Wash water may be supplied to the sump 240 through a water supply channel 241 and drained from the sump 240 through a drainage channel 243. Wash water introduced into the first channel P1 may be supplied to the second channel P2 through a valve V. The second channel P2 may supply the wash water to the first arm 250. A third arm 270 may be disposed above the upper rack 220 to spray wash water to the upper rack 220. Wash water may be supplied from the second channel P2 to the third arm 270. The third arm 270 may be rotatably disposed above the upper rack 220.

The position of the third arm 270 and its ability to rotate may negatively impact, or restrict, a size of objects received in the upper rack 220. As a result, the size of the tub 21 may have to be increased to accommodate the third arm 270. Also, it may be difficult to supply wash water to objects to be washed outside the radius of rotation of the third arm 270. In addition, a space to accommodate the first arm 250 between the upper rack 220 and the lower rack 230 may also detract from usable washing space. In certain circumstances, a volume of the tub 210 may be dictated by the use of a standard sized cabinet and/or installation space. As a result, a height of the racks 220 and 230 or a size of objects to be washed that may be received in the lower rack 230 may be restricted by the position of the first arm 250. Thus, it may be difficult to efficiently utilize the washing space provided by the tub 210 because of the first arm 250 and the third arm 270, and it may be difficult for the third arm 270 to uniformly supply wash water to objects to be washed.

Figure 2:
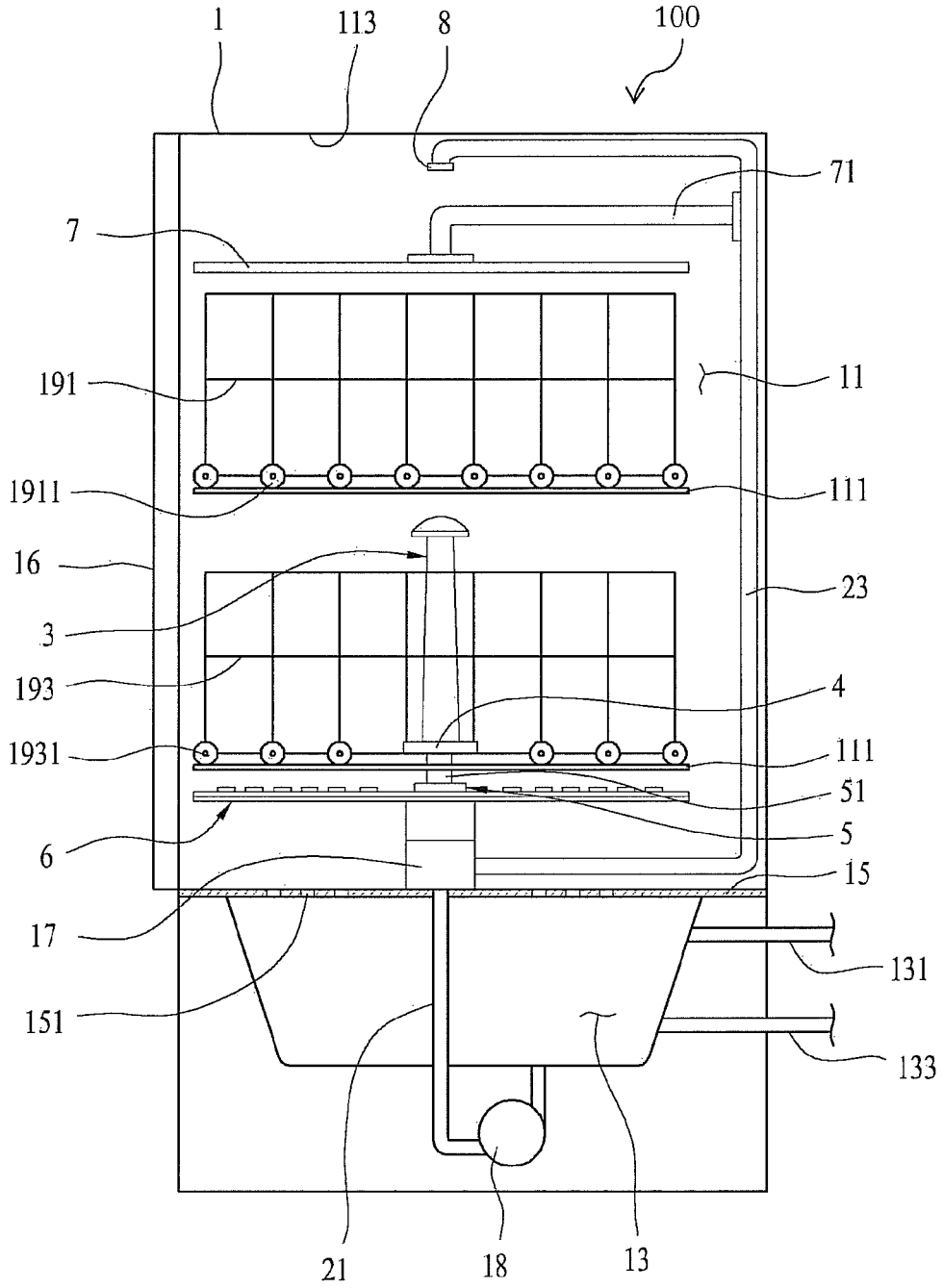
FIG. 2 is a schematic view of a dishwashing machine according to an embodiment as broadly described herein.

FIG. 2 is a schematic view of a dishwashing machine 100 according to an embodiment as broadly described herein. The dishwashing machine 100 of FIG. 2 may include a cabinet 1 that forms an external appearance of the dishwashing machine 100, a tub 11 disposed in the cabinet 1 to provide a washing space, a sump 13 below the tub 11 to store wash water, a sump cover 15 disposed at an upper side of the sump 13 to isolate the tub 11 and the sump 13 from each other, and a door 16 provided to open and close the washing space.

The sump 13 may be connected to a sump water supply channel 131 to supply wash water, and may be connected to a sump drainage channel 133 to drain wash water from the sump 13. The sump cover 15 may include collection holes 151 to collect wash water sprayed into the washing space through lower and upper arm spray nozzles 6 and 7 and a top nozzle 8 into the sump 13.

One or more racks may be provided in the tub 11 to receive objects therein, such as dishes, to be washed. The racks may include a first rack 191 and a second rack 193 disposed below the first rack 191. Hereinafter, the first rack 191 will be referred to as an upper rack and the second rack 193 will be referred to as a lower rack for the sake of convenience.

The upper rack 191 and the lower rack 193 may be withdrawn from the tub 11 when the washing space is opened by the door 16. Rails 111, which may extend from a rear of the tub 11 to the door 16, may be provided at an inner peripheral surface of the tub 11. In addition, the upper rack 191 and the lower rack 193 may include wheels 1911 and 1931, by which the upper rack 191 and the lower rack 193 are supported on the rails 111.

The dishwashing machine 100 according to this embodiment may further include a lower arm spray nozzle 6 provided in the tub 11 to wash objects received in the lower rack 193 and a spray nozzle upper arm 7 provided in the tub 11 to wash objects received in the upper rack 191. In addition, the dishwashing machine 100 according to this embodiment may further include a top nozzle 8 disposed at an uppermost part of the tub 11.

The lower arm spray nozzle 6 may be rotatably installed in the tub 11 by an arm holder 17 fixed to the sump cover 15 to receive wash water stored in the sump 13 through a water supply pump 18 and a water supply channel.

The water supply channel may include a first channel 21 connected between the water supply pump 18 and the arm holder 17 and a second channel 23 connected between the arm holder 17 and the top nozzle 8. In this case, the upper arm 7 may be connected to the second channel 23 via a second channel connection pipe 71. Consequently, wash water discharged from the sump 13 through the water supply pump 18 may be supplied to the arm holder 17 through the first channel 21. Some of the wash water supplied to the arm holder 17 may be supplied to the lower arm 6, which communicates with the arm holder 17, and the remainder of the wash water may flow along the second channel 23. Alternatively, some of the wash water introduced into the second channel 23 may be supplied to the upper arm 7 through the second channel connection pipe 71 and the remainder of the wash water may flow to the top nozzle 8.

The upper arm 7 may be disposed above the upper rack 191. The upper arm 7 may be rotatably coupled to the second channel connection pipe 71 such that, when wash water is sprayed, the upper arm 7 may be rotated by a repulsive force of the wash water.

The top nozzle 8 may be provided at a position higher than the upper arm 7, for example, at a top 113 of the tub 11. The top nozzle 8 may receive wash water from the second channel 23 and spray the wash water to the upper rack 191 and the lower rack 193.

Figure 3:
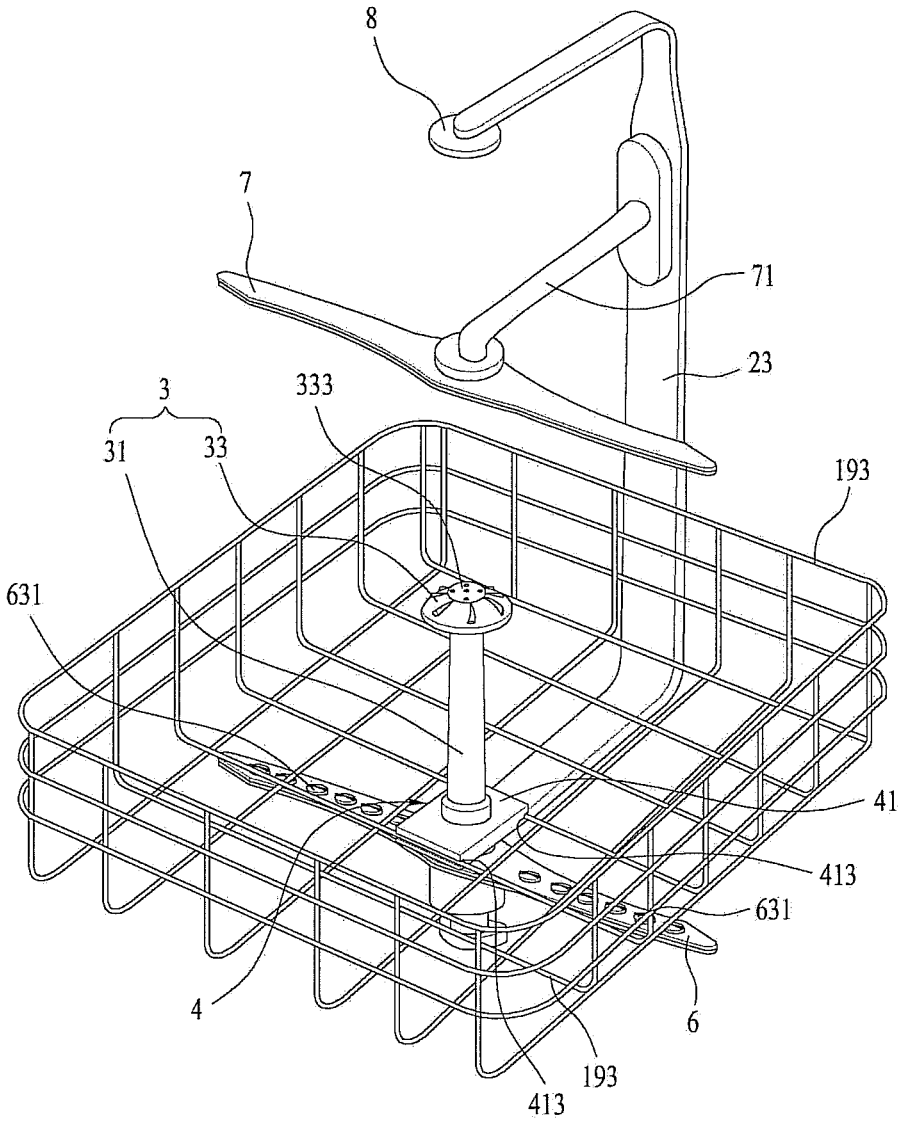
FIG. 3 is a perspective view showing a coupling structure of a tower nozzle and a lower rack of the dishwashing machine shown in FIG. 2.

The dishwashing machine 100 according to this embodiment may also include a tower nozzle 3 fixed to the lower rack 193, the tower nozzle 3 extending to the upper rack 191, and a tower connection device 5 provided in the lower arm 6 such that the tower connection device 5 may be connected to or disconnected from the tower nozzle 3 depending upon water pressure in the lower arm 6. As shown in FIGS. 3 and 4, the tower nozzle 3 may be removably connected to lower rack 193 via a rack fixing device 4. The tower nozzle 3 may include a tower channel 31 coupled to the rack fixing device 4 such that wash water supplied through the tower connection device 5 may flow along the tower channel 31 and a spray nozzle 33 to spray wash water supplied through the tower channel 31.

The tower channel 31 may be formed in a cylindrical shape having an open top and bottom. The spray nozzle 33 may be coupled to the open top of the tower channel 31 and the rack fixing device 4 may be coupled to the open bottom of the tower channel 31. A diameter of the tower channel 31 may gradually decrease from the bottom to the top thereof, such that wash water introduced into the bottom of the tower channel 31 may flow to the top of the tower channel 31 while water pressure of the wash water may be uniformly maintained.

Figure 4A:
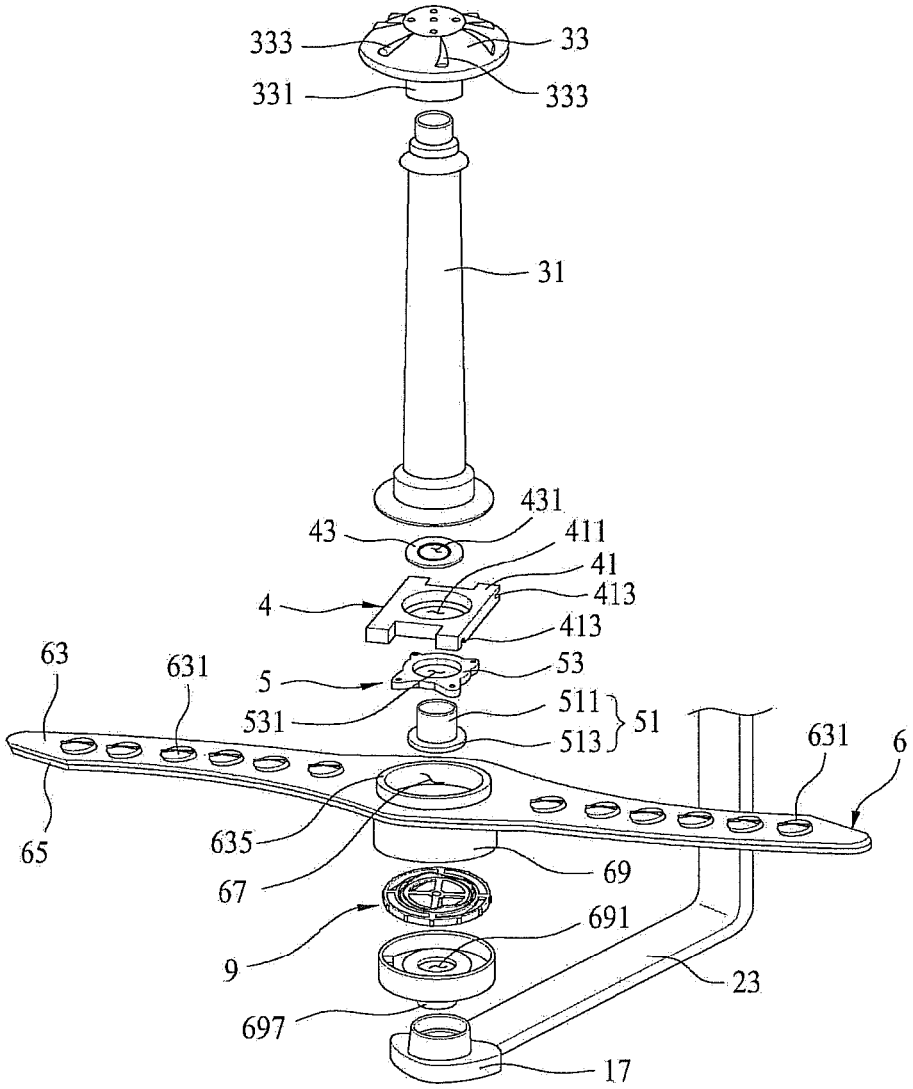
FIG. 4A is an exploded perspective view of tower nozzle, a rack fixing device, a tower connection, and a lower arm of the dishwashing machine shown in FIG. 2.
Figure 4B:
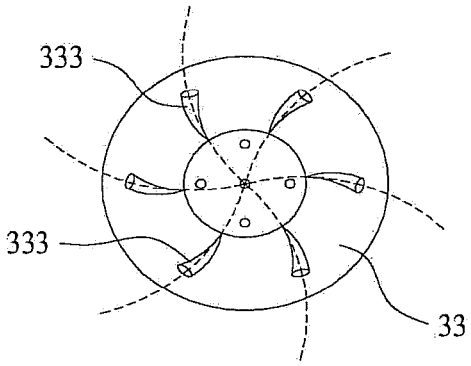
FIG. 4B is a top view of a spray nozzle shown in FIG. 4A.

As shown in FIGS. 4A-4B, the spray nozzle 33 may include a connection pipe 331 coupled to the top of the tower channel 31 and a plurality of spray holes 333, through which wash water introduced into die spray nozzle 33 through the connection pipe 331 may be discharged from the spray nozzle 33. The connection pipe 331 may couple the spray nozzle 33 to the tower channel 31 such that the spray nozzle 33 may be rotated. The spray holes 333 may be configured such that the spray nozzle 33 may be rotated by a repulsive force of the wash water discharged from the spray nozzle 33. That is, the spray holes 333 may be arranged at a top of the spray nozzle 33 in a spiral shape (sec FIG. 4B) to rotate the spray nozzle 33 in a clockwise direction or in a counterclockwise direction when wash water is sprayed through the spray holes 333.

The rack fixing device 4 may include a rack fixing body 41 fixed to the lower rack 193 (see FIG. 3) to support the tower channel 31. As shown in FIG. 4A, the rack fixing body 41 may include a fixing body through hole 411 and a rack coupling device 413.

The rack fixing body 41 may be removably connected to the lower rack 193 by the rack coupling device 413. As shown in FIG. 4A, the rack coupling device 413 may be formed by bending a portion of the rack fixing body 41 in a concave contour. Alternatively, the rack coupling device 413 may be configured to have another structure, for example, a hook structure or other structure as appropriate by which the rack fixing body 41 may be removably connected to the lower rack 193.

The fixing body through hole 411 may be formed through the rack fixing body 41. A removable pipe coupling device 43 to which a removable pipe body 511 of the tower connection device 5 may be provided in the fixing body through hole 411. The removable pipe coupling device 43 may include a removable pipe receiving hole 431 through which the removable pipe body 511 may be inserted. When the removable pipe body 511 is inserted through the removable pipe receiving hole 431, the removable pipe body 511 may be connected to the tower channel 31.

The dishwashing machine 100 may also include a tower connection device 5 configured to be withdrawn from the lower arm 6. The tower connection device 5 may be withdrawn from the lower arm 6 depending upon pressure in a removable pipe chamber 67, and may then be connected to the removable pipe receiving hole 431. When the tower connection device 5 is connected to the removable pipe receiving hole 431, wash water may be supplied to the tower channel 31.

The tower connection device 5 may include a tower removable pipe 51 configured to be withdrawn from the removable pipe chamber 67 of the lower arm 6 and an arm fixing body 53 fixed to the lower arm 6. The tower removable pipe 51 may include a removable pipe body 511 formed in a cylindrical shape having an open top and bottom and a removable pipe flange 513 provided at an outer circumference of the removable pipe body 511. The removable pipe coupling device 43, which may be provided at the rack fixing device 4, may be formed of an elastic material, such as rubber, to prevent leakage of wash water supplied to the tower channel 31.

That is, when the removable pipe body 511 is withdrawn from the removable pipe chamber 67 by water pressure in the removable pipe chamber 67, the removable pipe body 511 may be inserted through the removable pipe receiving hole 431. In a case in which the removable pipe coupling device 43 is formed of an elastic material, the removable pipe body 511 may come into tight contact with the removable pipe receiving hole 431, thereby preventing wash water in the tower channel 41 from being discharged into a space defined between the removable pipe receiving hole 431 and the removable pipe body 511. Furthermore, in a case in which the removable pipe coupling device 43 is formed of an elastic material, it may be possible to prevent wash water in the tower channel 41 from being discharged into the space defined between the removable pipe receiving hole 431 and the removable pipe body 511 even when a diameter of the removable pipe body 511 is greater than a diameter of the removable pipe receiving hole 431.

The arm fixing body 53 may include a through hole 531 through which the removable pipe body 511 may be inserted. A diameter of the through hole 531 may be greater than or equal to a diameter of the outer circumference of the removable pipe body 511, and may be less than a diameter of the removable pipe flange 513. This may prevent the removable pipe body 511 from being withdrawn from the lower arm 6.

The lower arm 6 of the dishwashing machine 100 may include a lower arm chamber 69 that communicates with the arm holder 17 such that wash water may be introduced into the lower arm chamber 69, a removable pipe chamber 67 that communicates with the lower arm chamber 69, the tower removable pipe 51 being received in the removable pipe chamber 67, and an arm channel 61 that communicates with the lower arm chamber 69.

Figure 5:
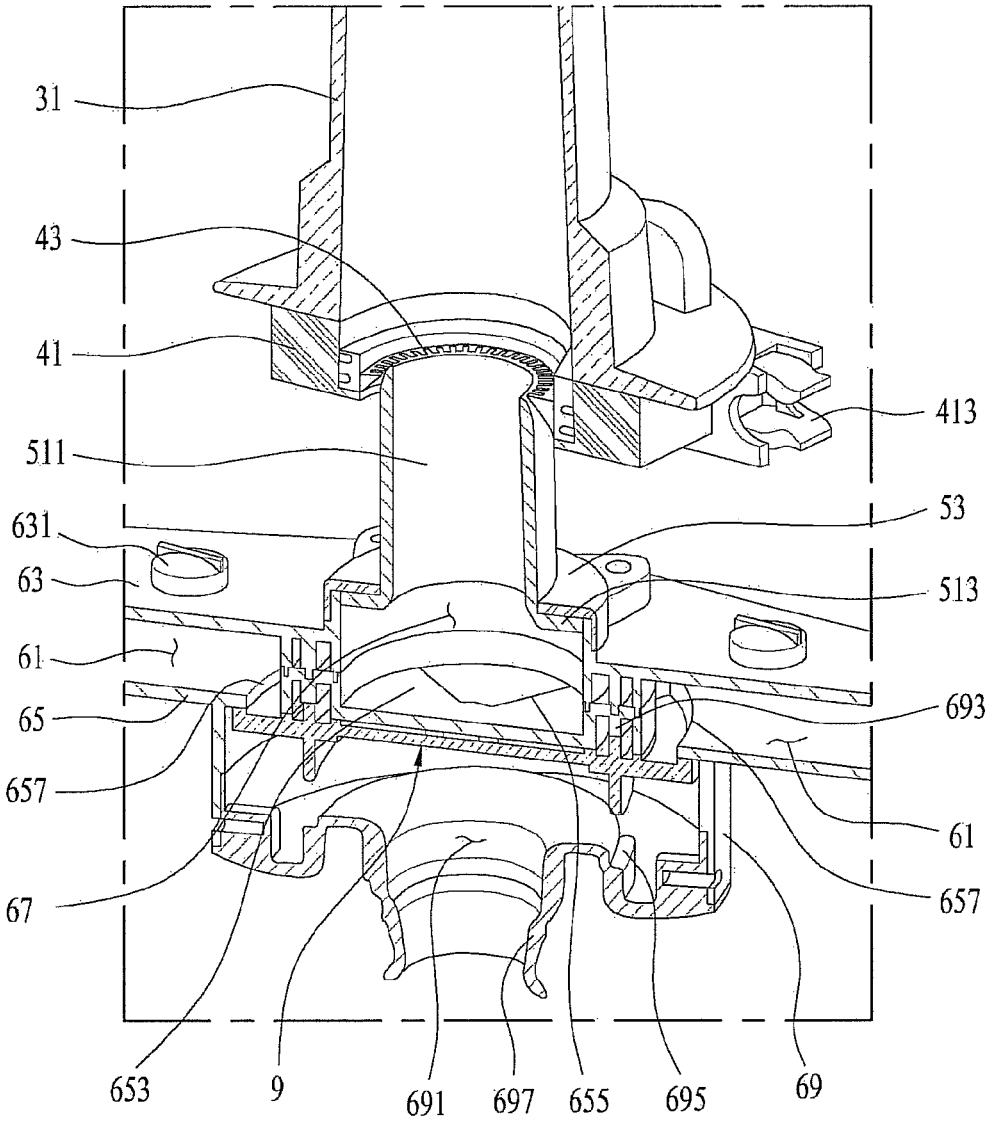
FIG. 5 is a cross-sectional view of a coupling structure of the tower nozzle, the rack fixing device, the tower connection device, and the lower arm shown in FIG. 4A.

As shown in FIG. 5, the arm channel 61 may be defined by an upper frame 63 and a lower frame 65. The arm channel 61 may communicate with the lower arm chamber 69 via arm channel communication holes 657.

Figure 6A:
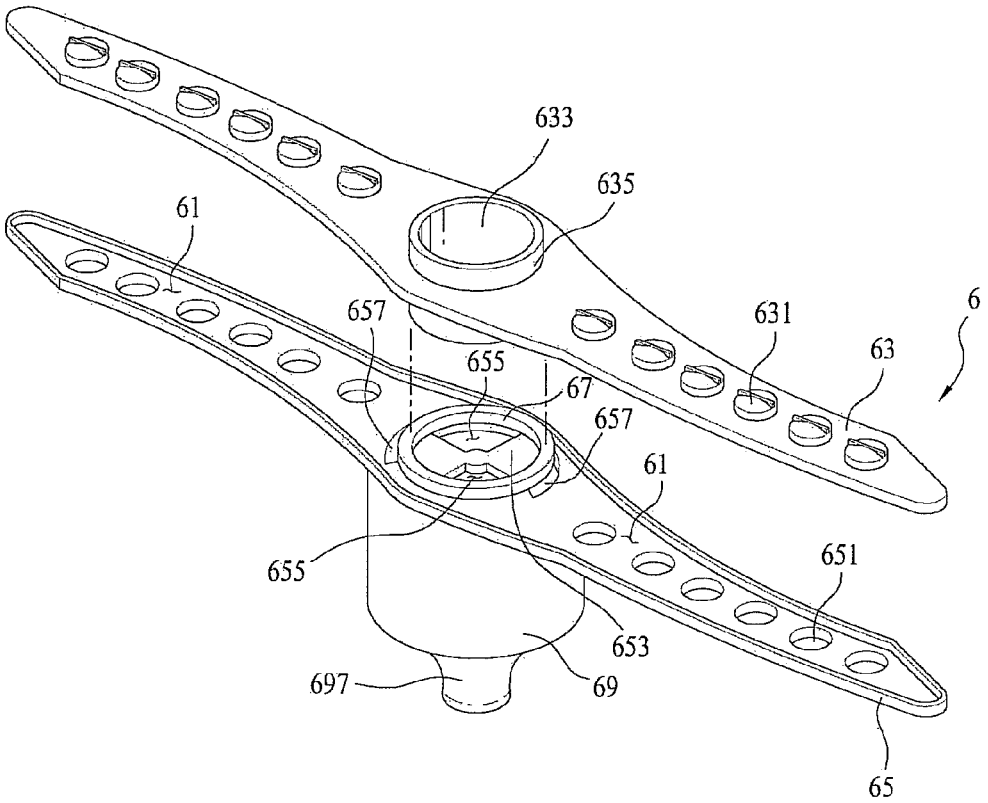
FIGS. 6A-6B are an exploded perspective view and a side view of the lower arm shown in FIG. 4A.
Figure 6B:
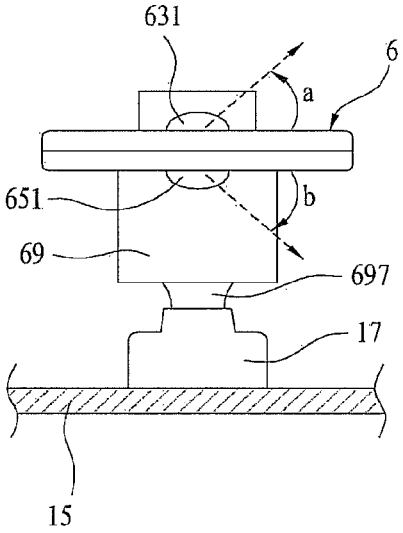

As shown in FIGS. 6A-6B, the upper frame 63 may include upper spray holes 631 to spray wash water in the arm channel 61 to the lower rack 193, a frame through hole 633 in which the tower removable pipe 51 may be received, and a fixing body connection device 635 to which the arm fixing body 53 may be coupled. The lower frame 65 may include arm channel communication holes 657 to connect the lower arm chamber 69 and the arm channel 61, lower spray holes 651 to spray wash water introduced into the arm channel 61 to the sump 15, a chamber partition wall 653 to isolate the lower arm chamber 69 and the removable pipe chamber 67 from each other, and chamber communication holes 655 provided at the chamber partition wall 653 to connect the lower arm chamber 69 and the removable pipe chamber 67.

The removable pipe chamber 67 may be disposed in a space defined between one of the arm channel communication holes 657 and the other arm channel communication hole 657. The removable pipe chamber 67 may be configured as a wall extending from a surface of the lower frame 65 to the fixing body connection device 635 of the upper frame 63.

As shown in FIG. 5, the lower arm chamber 69 may be provided below the lower frame 65 to surround the arm channel communication holes 657. The lower arm chamber 69 may include an arm holder connection pipe 697 rotatably coupled to the arm holder 17, an introduction hole 691 formed through the arm holder connection pipe 697 such that wash water may be introduced into the lower arm chamber 69 through the introduction hole 691, a lower gear engagement device 695 provided at a bottom of the lower arm chamber 69, and an upper gear engagement device 693 provided at a top of the lower arm chamber 69.

The lower gear engagement device 695 may be coupled to a lower gear 99 of a channel change device 9, to rotate the channel change device 9 by a predetermined angle. The lower gear engagement device 695 may be provided along an outer circumference of the introduction hole 691.

The upper gear engagement device 693 may be coupled to an upper gear 97 of the channel change device 9 to rotate the channel change device 9 by a predetermined angle. The upper gear engagement device 693 may be provided at the top of the lower arm chamber 69 in a space defined between the removable pipe chamber 67 and the arm channel communication holes 657. That is, the upper gear engagement device 693 may be provided in a space defined between the removable pipe chamber 67 and the arm channel communication holes 657 to surround the outer circumference of the removable pipe chamber 67.

As shown in FIG. 6B, the upper spray holes 631 provided at the upper frame 63 may spray wash water at a predetermined angle "a" toward a surface of the upper frame 63 such that the lower arm 6 may be rotated about the arm holder connection pipe 697 by a repulsive force of wash water discharged from the arm channel 61. In addition, the lower spray holes 651 provided at the lower frame 65 may spray wash water at a predetermined angle "b" toward the surface of the lower frame 65, such that the lower arm 6 may be rotated about the arm holder connection pipe 697 by a repulsive force of wash water discharged from the arm channel 61.

The lower spray holes 651 spray wash water to the sump cover 15. When the lower arm 6 is rotated, therefore, it may be possible to prevent the collection holes 151 of the sump cover 15 from being clogged by foreign matter.

The channel change device 9 is provided in the lower arm chamber 69 to alternately open the chamber communication holes 655 and the arm channel communication holes 657 depending upon a pressure in the lower arm chamber 69.

Figure 7A:
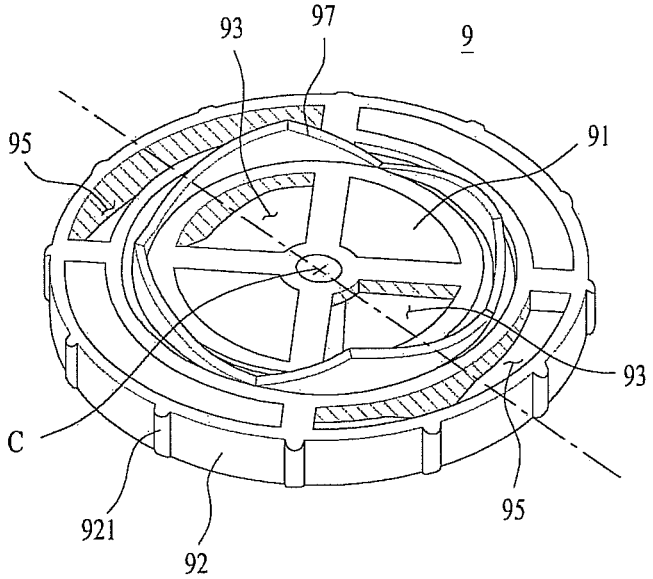
FIG. 7A-7C illustrate a channel change device of the dishwashing machine according to an embodiment as broadly described herein.
Figure 7B:
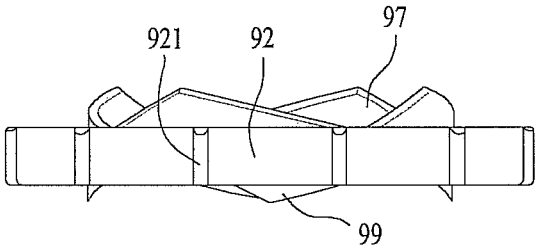
Figure 7C:
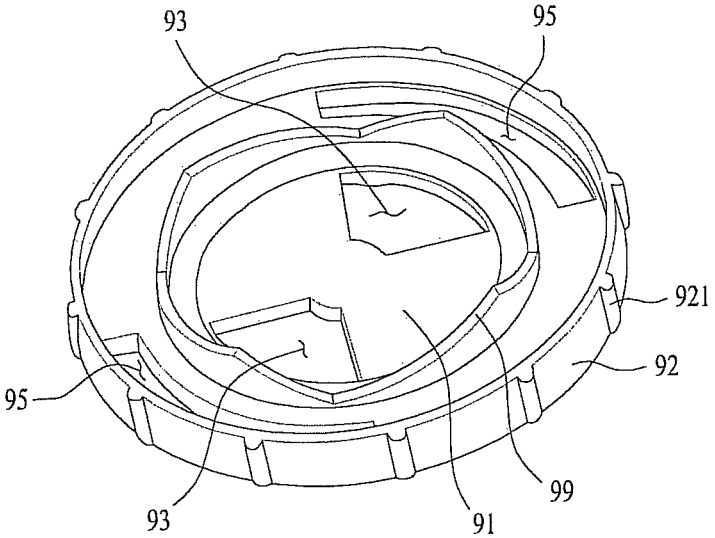

As shown in FIGS. 7A-7C, the channel change device 9 may include a channel change device body 91 disposed in the lower arm chamber 69, chamber opening holes 93 formed through the channel change device body 91 to open the chamber communication holes 655, and arm channel opening holes 95 formed through the change device body 91 to open the arm channel communication holes 657. The change device body 91 may be reciprocated between the bottom of the lower arm chamber 69 and the top of the lower arm chamber 69 depending upon a water pressure in the lower arm chamber 69. The change device body 91 may be formed in the shape of a disc.

That is, when the water pressure in the lower arm chamber 69 is relatively high (for example, when wash water is supplied to the lower arm chamber 69), the change device body 91 moves from the bottom of the lower arm chamber 69 to the top of the lower arm chamber 69. On the other hand, when the water pressure in the lower arm chamber 69 is relatively low (for example, when wash water is not supplied to the lower arm chamber 69), the change device body 91 moves from the top of the lower arm chamber 69 to the bottom of the lower arm chamber 69.

The change device body 91 may be provided at an outer circumference thereof with a flange 92 to guide reciprocation of the change device body 91. The flange 92 may contact an inner circumference of the lower arm chamber 69 to guide reciprocation of the change device body 91 and to assist the change device body 91 in maintaining horizontality during reciprocation of the change device body 91. The flange 92 may be provided with a plurality of protrusions (change device protrusions) 921 or a plurality of grooves to prevent foreign matter from being caught between the flange 92 and the inner circumference of the lower arm chamber 69.

In addition, the change device body 91 may be provided at a top thereof with an upper gear 97 coupled to the upper gear engagement device 693 provided at the lower arm chamber 69 and the change device body 91 may be provided at a bottom thereof with a lower gear 99 coupled to the lower gear engagement device 695. The upper gear 97 may be coupled to the upper gear engagement device 693 to rotate the change device body 91 in a clockwise direction (or in a counterclockwise direction) and the lower gear 99 may be coupled to the lower gear engagement device 695 to rotate the change device body 91 in the clockwise direction (or in the counterclockwise direction).

The lower gear 99 and the lower gear engagement device 695 may rotate the change device body 91 in the same direction in which the change device body 91 is rotated when the upper gear 97 is coupled to the upper gear engagement device 693. The upper gear 97 and the upper gear engagement device 693 may be formed in a shape to rotate the change device body 91 by a predetermined angle in a clockwise direction (or in a counterclockwise direction) when the upper gear 97 and the upper gear engagement device 693 are coupled to each other. The lower gear 99 and the lower gear engagement device 695 may be formed in a shape to rotate the change device body 91 by a predetermined angle in the clockwise direction (or in the counterclockwise direction) when the lower gear 99 and the lower gear engagement device 695 are coupled to each other.

In a case in which the chamber communication holes 655 and the arm channel communication holes 657 provided at the lower arm 6 are spaced apart from each other by 90 degrees, as shown in FIGS. 6A-6B, centers of the chamber opening holes 93 and centers of the arm channel opening holes 95 may be arranged on a straight line passing through a center of rotation C of the change device body 91. In this case, the upper gear engagement device 693 and the upper gear 97 may be formed such that the change device body 91 may be rotated by approximately 45 degrees in a clockwise direction (or in a counterclockwise direction) to open the chamber communication holes 655 or the arm channel communication holes 657 when the upper gear engagement device 693 and the upper gear 97 are engaged with each other. On the other hand, the lower gear engagement device 695 and the lower gear 99 may be formed such that the change device body 91 may be rotated by approximately 45 degrees in the clockwise direction (or in the counterclockwise direction) when the lower gear engagement device 695 and the lower gear 99 are engaged with each other.

Alternatively, the chamber opening holes 93 and the arm channel opening holes 95 may be spaced apart from each other by approximately 90 degrees based on the center of rotation C of the change device body 91 and the chamber communication holes 655 and the arm channel communication holes 657 may be arranged on a straight line.

Motion of the channel change device 9 will be described with reference to FIGS. 8A-8H. When the water supply pump 18 is not operated, and thus wash water is not supplied to the lower arm chamber 69, the channel change device 9 may remain in contact with the bottom of the lower arm chamber 69 (see FIG. 8A-8B). In this case, the tower removable pipe 51 may remain located in the removable pipe chamber 67 with the result that the removable pipe body 511 is not connected to the lower channel 31.

When the water supply pump 18 is operated, and thus wash water is supplied to the arm holder 17 through the first channel 21, the upper arm 7 and the top nozzle 8 may receive the wash water through the second channel 23, and the lower arm chamber 69 receives the wash water through the arm holder 17.

Figure 8A:
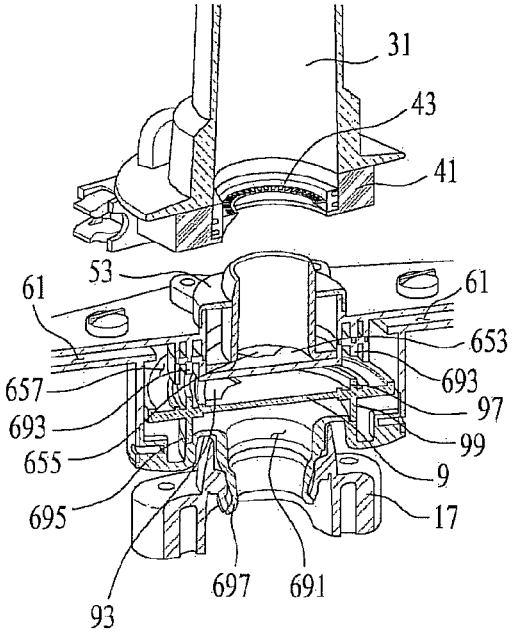
FIGS. 8A-8H illustrate motion of the channel change device of the dishwashing machine, according to an embodiment as broadly described herein.
Figure 8B:
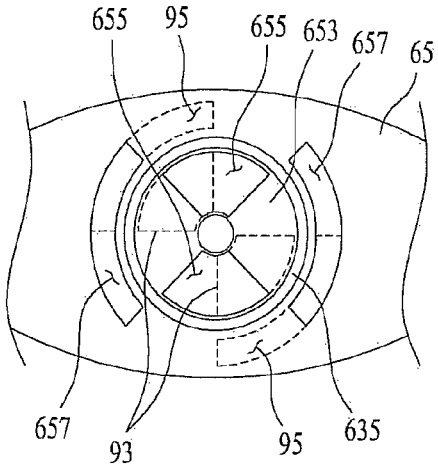
Figure 8C:
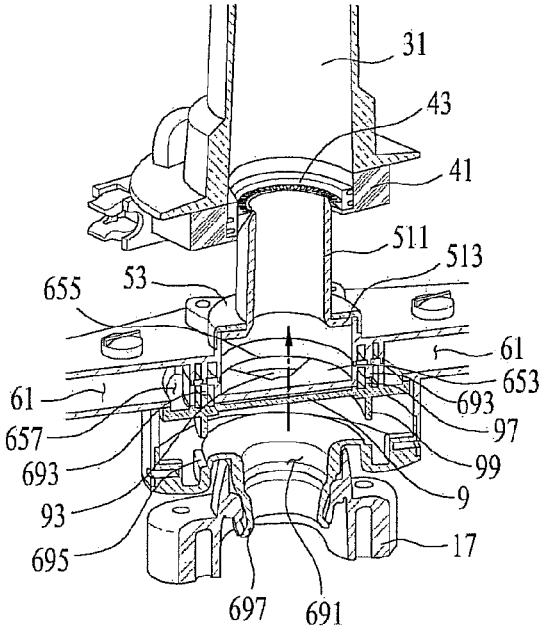
Figure 8D:
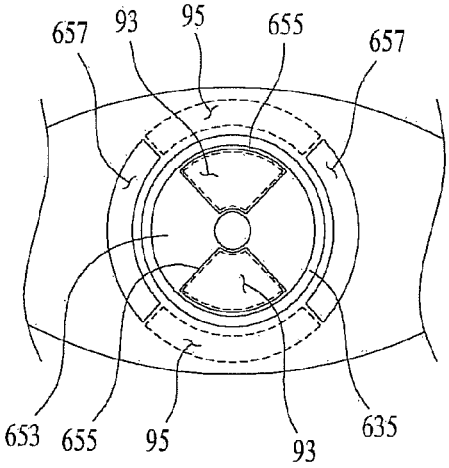
Figure 8E:
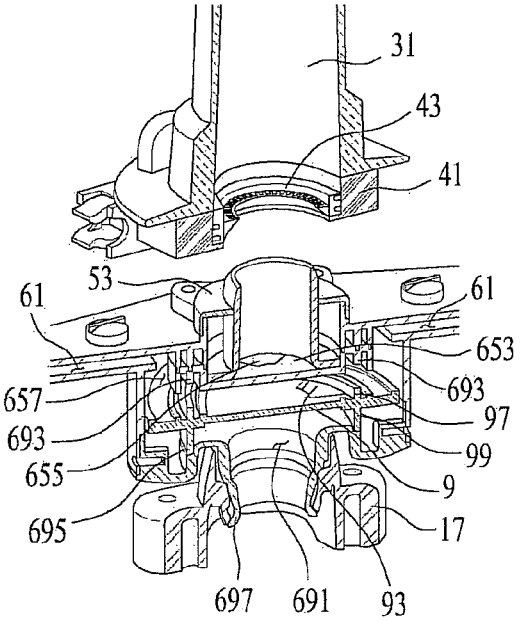
Figure 8F:
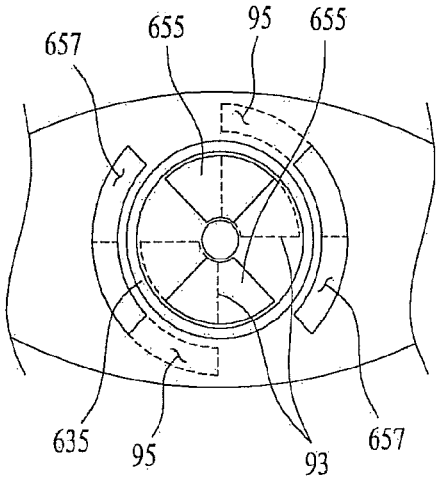
Figure 8G:
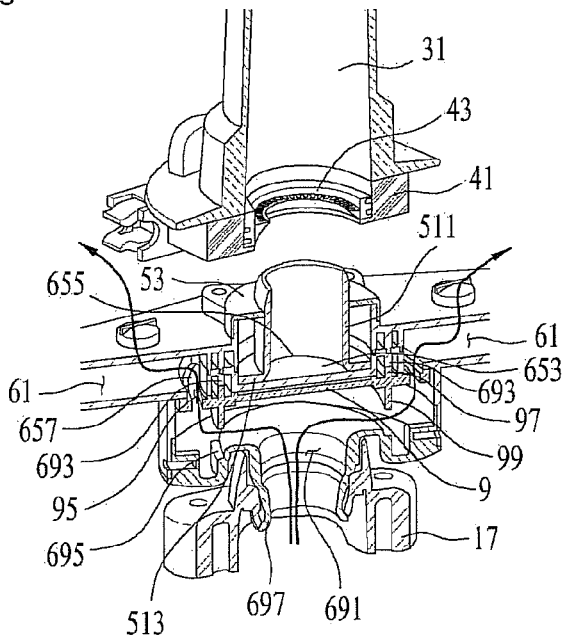
Figure 8H:
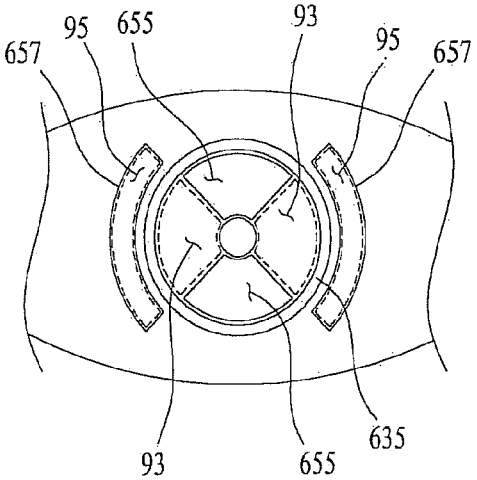

When the wash water is supplied to the lower arm chamber 69, the channel change device 9 may move to the top of the lower arm chamber 69, causing the upper gear 97 to be coupled to the upper gear engagement device 693 (see FIGS. 8C-8D).

When the upper gear 97 and the upper gear engagement device 693 are coupled to each other, the channel change device 9 may be rotated in the lower arm chamber 69 by approximately 45 degrees in a clockwise direction, causing the chamber opening holes 93 open the chamber communication holes 655. At this time, the arm channel communication holes 657 may remain closed by the change device body 91, with the result that wash water may not be supplied to the arm channel 61.

When the chamber communication holes 655 are opened by the chamber opening holes 93, wash water in the lower arm chamber 69 may be introduced into the removable pipe chamber 67 (see the arrow in FIG. 8C). When the wash water is introduced into the removable pipe chamber 67, the tower removable pipe 51 may be moved upward in the removable pipe chamber 67 by water pressure.

When the tower removable pipe 51 is moved upward in the removable pipe chamber 67, the removable pipe body 511 may be inserted through the removable pipe receiving hole 431 of the rack fixing device 4, and the wash water in the removable pipe chamber 67 may be supplied to the tower channel 31. When the operation of the water supply pump 18 is stopped, on the other hand, wash water may not be supplied to the lower arm chamber 69, and the channel change device 9 may move to the bottom of the lower arm chamber 69 (see FIGS. 8E-8F).

When the channel change device 9 moves to the bottom of the lower arm chamber 69, the lower gear 99 may be coupled to the lower gear engagement device 695, and the channel change device 9 may be rotated by approximately 45 degrees in a clockwise direction. Consequently, centers of the chamber opening holes 93 and centers of the chamber communication holes 655 are spaced apart from each other by approximately 45 degrees, with the result that centers of the arm channel opening holes 95 and centers of the arm channel communication holes 657 are also spaced apart from each other by approximately 45 degrees.

In addition, the removable pipe body 511 may be separated from the removable pipe coupling device 43 and then move to the removable pipe chamber 67, with the result that the removable pipe body 511 may be separated from the tower channel 31. Subsequently, when wash water is resupplied to the lower arm chamber 69 through the water supply pump 18, the channel change device 9 may move to the top of the lower arm chamber 69, and the upper gear 97 may be coupled to the upper gear engagement unit 693 (see FIGS. 8G-8H).

When the upper gear 97 and the upper gear engagement device 693 are coupled to each other, the channel change device 9 may be rotated by approximately 45 degrees in a clockwise direction, and the arm channel communication holes 657 may be opened by the arm channel opening holes 95. At this time, the chamber communication holes 655 may remain closed by the change device body 91, so that wash water may not be supplied to the removable pipe chamber 67.

When the arm channel communication holes 657 are opened by the arm channel opening holes 95, wash water in the lower arm chamber 69 may be introduced into the arm channel 61. The wash water introduced into the arm channel 61 may be sprayed (see arrows in FIG. 8G) to the lower rack 193 and the sump cover 15 through the upper spray holes 631 and the lower spray holes 651, respectively. At this time, the lower arm 6 may be rotated about the arm holder connection pipe 697. Subsequently, when the operation of the water supply pump 18 is temporarily stopped, wash water may not be supplied to the lower arm chamber 69, causing the channel change device 9 to move to the bottom of the lower arm chamber 69 (see FIGS. 8A-8B).

When the channel change device 9 moves to the bottom of the lower arm chamber 69, the lower gear 99 may be coupled to the lower gear engagement device 695, and the channel change device 9 may be rotated by approximately 45 degrees in the clockwise direction. Consequently, the centers of the chamber opening holes 93 and the centers of the chamber communication holes 655 may be spaced apart from each other by approximately 45 degrees, with the centers of the arm channel opening holes 95 and the centers of the arm channel communication holes 657 then spaced apart from each other by approximately 45 degrees.

Figure 9:
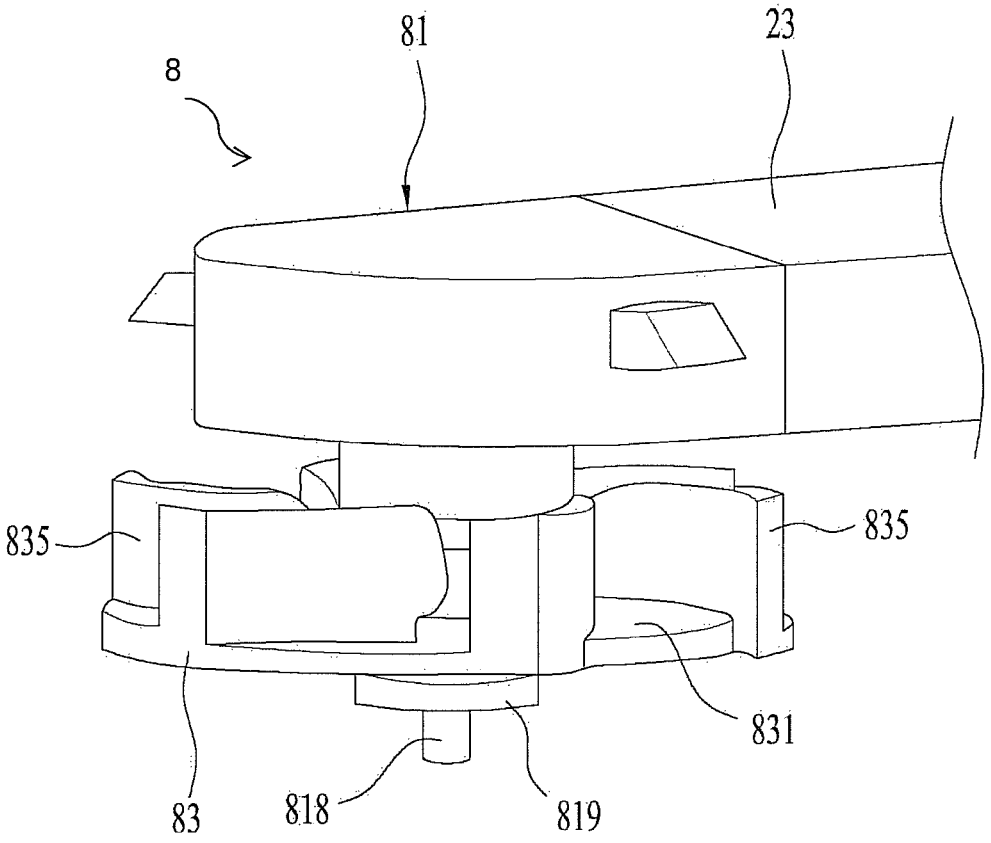
FIGS. 9 and 10A-10B illustrate a top nozzle of the dishwashing machine, according to an embodiment as broadly described herein.
Figure 10A:
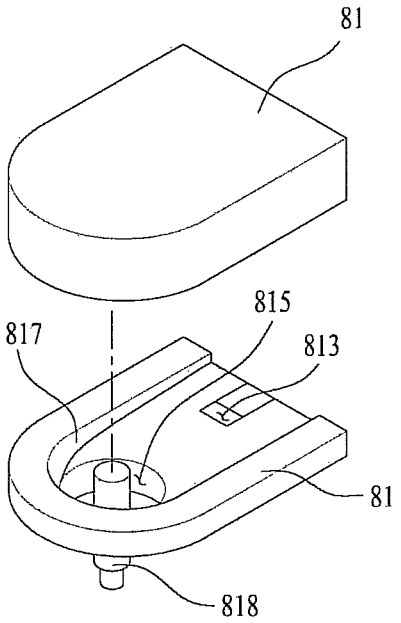
Figure 10B:
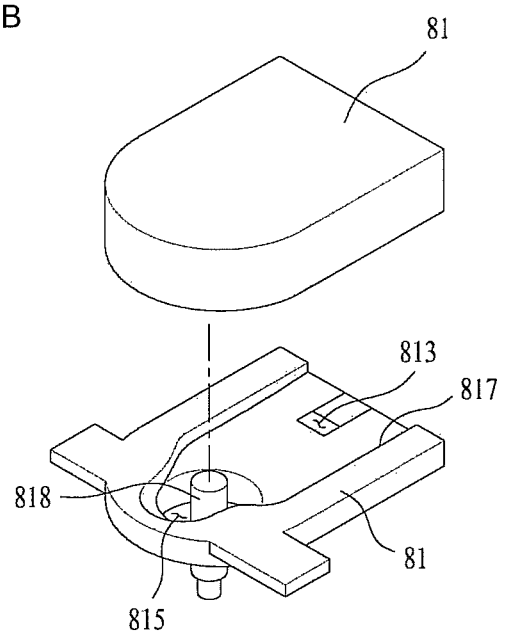

FIG. 9 is a perspective view showing the top nozzle of the dishwashing machine. The top nozzle 8 may be disposed above the upper rack 191 to spray wash water to the upper rack 191 and the lower rack 193. The top nozzle 8 may be connected to the second channel 23.

In some dishwashing machines, the top nozzle 8 may be configured as a rotary arm, similar to the lower arm 6 and/or the upper arm 7 described above. In a case in which the top nozzle 8 is disposed above the upper rack 191 as shown in FIG. 9, however, this may cause a height of the tub 11 to be adversely impacted in a dishwashing machine having a fixed volume.

The top nozzle 8 of the dishwashing machine according to this embodiment may include a nozzle body 81 that forms an external appearance of the top nozzle 8, the nozzle body 81 being connected to the second channel 23, and an impeller 83 disposed at a lower side of the nozzle body 81 such that the impeller 83 may be rotated by wash water discharged from the nozzle body 81.

As shown in FIGS. 10A-10B and 11A-11B, the nozzle body 81 may include a nozzle introduction device 811 that communicates with the second channel 23, such that wash water may be introduced through the nozzle introduction device 811 and a discharge hole 815. The nozzle introduction device 811 may include a channel fixing device 813 to couple the nozzle body 81 and the second channel 23.

A channel guide 817 to guide wash water introduced through the nozzle introduction device 811 to the discharge hole 815 may be provided in the nozzle body 81. The channel guide 817 may be inclined such that a sectional area of the nozzle body 81, for example, a width of the nozzle body 81, may gradually decrease from the nozzle introduction device 811 to the discharge hole 815.

In addition, the nozzle body 81 may also include a shaft 818, to which the impeller 83 may be fixed. One end of the shaft 818 may be fixed in the nozzle body 81 and the other end of the shaft 818 may be exposed out of the nozzle body 81 through the discharge hole 815. However, a center of the shaft 818 and a center of the discharge hole 815 may be spaced apart from each other by a predetermined distance.

Figure 11A:
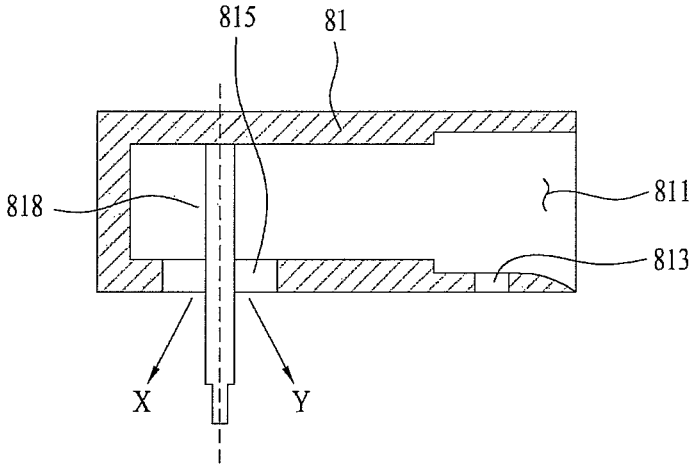
FIGS. 11A-11B are sectional views of the top nozzle of the dishwashing machine, according to embodiments as broadly described herein.

If the shaft 818 of the nozzle body 81 is disposed such that the center of the shaft 818 is aligned with the center of the discharge hole 815 as shown in FIG. 11A, a relatively large portion of the wash water introduced into the nozzle body 81 may be sprayed in a forward direction X of the shaft 818, while relatively little wash water may be sprayed in a backward direction Y of the shaft 818, due to pressure of the wash water introduced into the nozzle body 81 through the second channel 23. If wash water is supplied only in the forward direction X of the shaft 818 as shown in FIG. 11A, the wash water may not be uniformly supplied to the impeller 83 provided at the shaft 818, making it somewhat difficult to uniformly supply the wash water to objects to be washed received in the upper rack 191 or the lower rack 193.

Figure 11B:
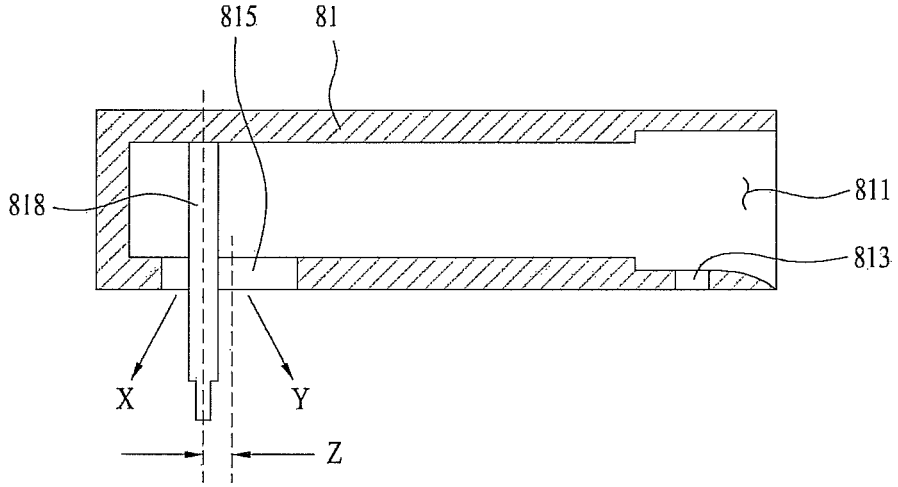

Accordingly, the top nozzle 8 of the dishwashing machine, according to embodiments as broadly described herein may be disposed such that the center of the shaft 818 and the center of the discharge hole 815 are spaced apart from each other by a predetermined distance Z (see FIG. 11B). That is, in a case in which the top nozzle 8 is provided at a position corresponding to the center of the top of the tub 11 or the center of the upper rack 191, the center of the shaft 818 may be spaced apart from the center of the discharge hole 815 by the predetermined distance Z in a direction opposite to a direction in which the nozzle introduction device 811 is disposed, for example, a direction in which wash water is introduced. As a result, the top nozzle 8 may spray almost the same amount of wash water in the forward direction X and the backward direction Y of the shaft 818.

Even in a case in which the center of the shaft 818 is aligned with the center of the discharge hole 815, however, the above-mentioned effect may be obtained by changing the position of the top nozzle 8. That is, in a case in which the second channel 23 is disposed at the rear of the tub 11 as shown in FIG. 1, when the top nozzle 8 is spaced apart from the center of the top 113 of the tub 11 toward the rear of the tub 11 (in a direction in which wash water is introduced into the nozzle body 81) by the predetermined distance, the above-mentioned effect may be obtained although the center of the shaft 818 and the center of the discharge hole 815 are not spaced apart from each other by the predetermined distance.

The impeller 83 may be rotatably provided at the shaft 818 to uniformly supply the wash water discharged from the discharge hole 815 to entire areas of the racks 191 and 193, having objects to be washed received therein. That is, the impeller 83 may be rotatably coupled to the shaft 818 via an impeller support device 819 (see FIG. 9) coupled to the shaft 818 to divide a supply range of the wash water discharged from the discharge hole 815, or a supply distance of the discharged wash water.

Figure 12:
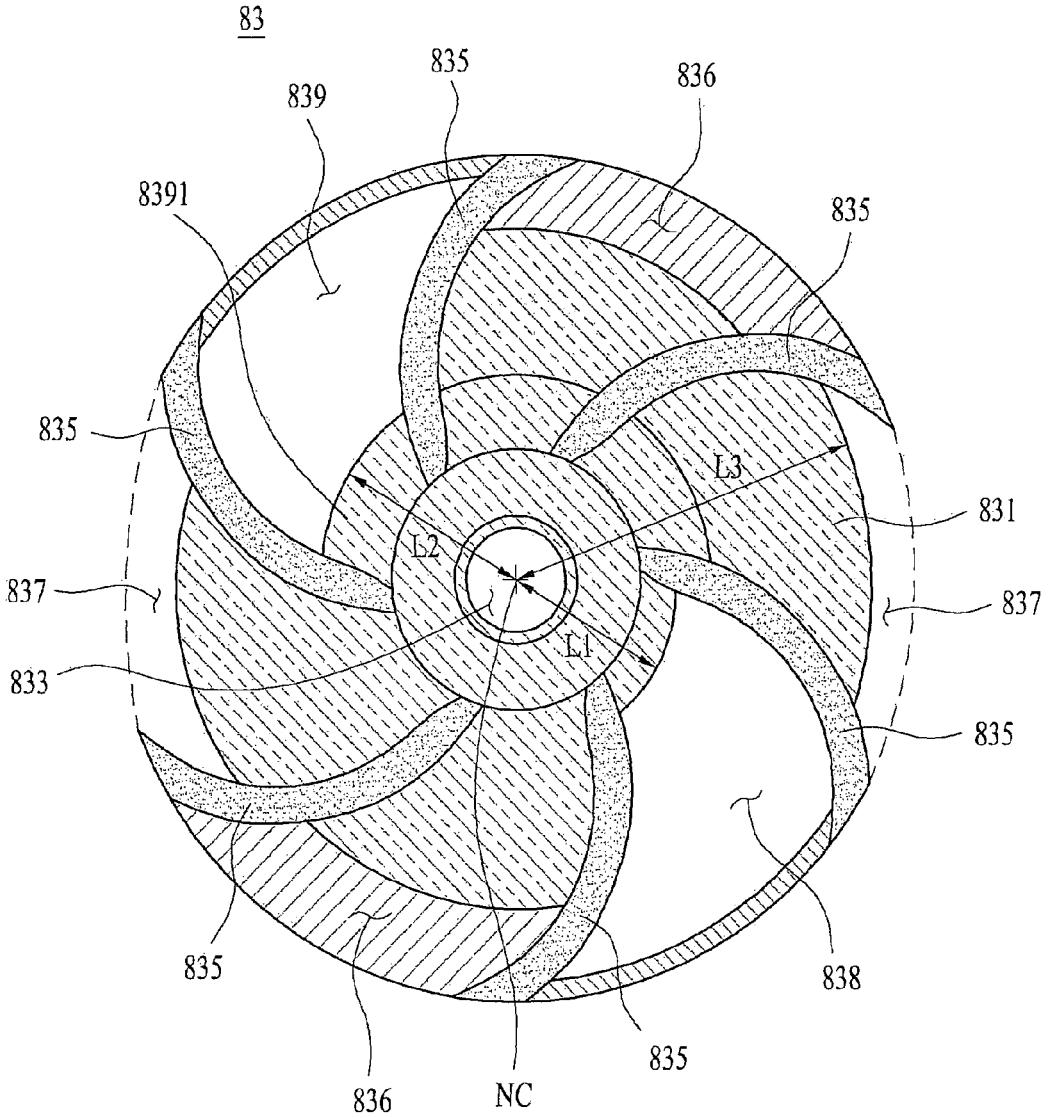
FIG. 12 is a plan view of an impeller of the top nozzle.

Hereinafter, a structure of the impeller 83 will be described with reference to FIG. 12. The impeller 83 may include a disc-shaped impeller body 831, a shaft through hole 833 formed through the impeller body 831, and a plurality of blades 835 extending from a center of rotation NC of the impeller 83 to an edge of the impeller body 831 in a spiral shape. Consequently, the wash water discharged from the nozzle body 81 through the discharge hole 815 may collide with the plurality of spiral blades 835, causing the impeller body 831 to rotate about the shaft 818.

When the impeller body 831 is rotated, the wash water discharged from the discharge hole 815 may scatter over the upper rack 191 as it is guided by the surface of the impeller body 831 and the plurality of blades 835. As the impeller body 831 is rotated, a force generated by the blades 835 may be applied to the wash water discharged from the discharge hole 815, thereby causing the wash water to travel farther.

In a case in which the impeller 83 is configured as described above, the top nozzle 8 may disperse wash water relatively far. However, the wash water may not be supplied near the top nozzle 8. In order to solve this problem, the impeller 83 may also include at least one of: one or more holes formed through the impeller body 831; an inclined surface 836 provided at the edge of the impeller body 831; or a bent groove 837 provided at the edge of the impeller body 831.

Figures 13A, 13B:
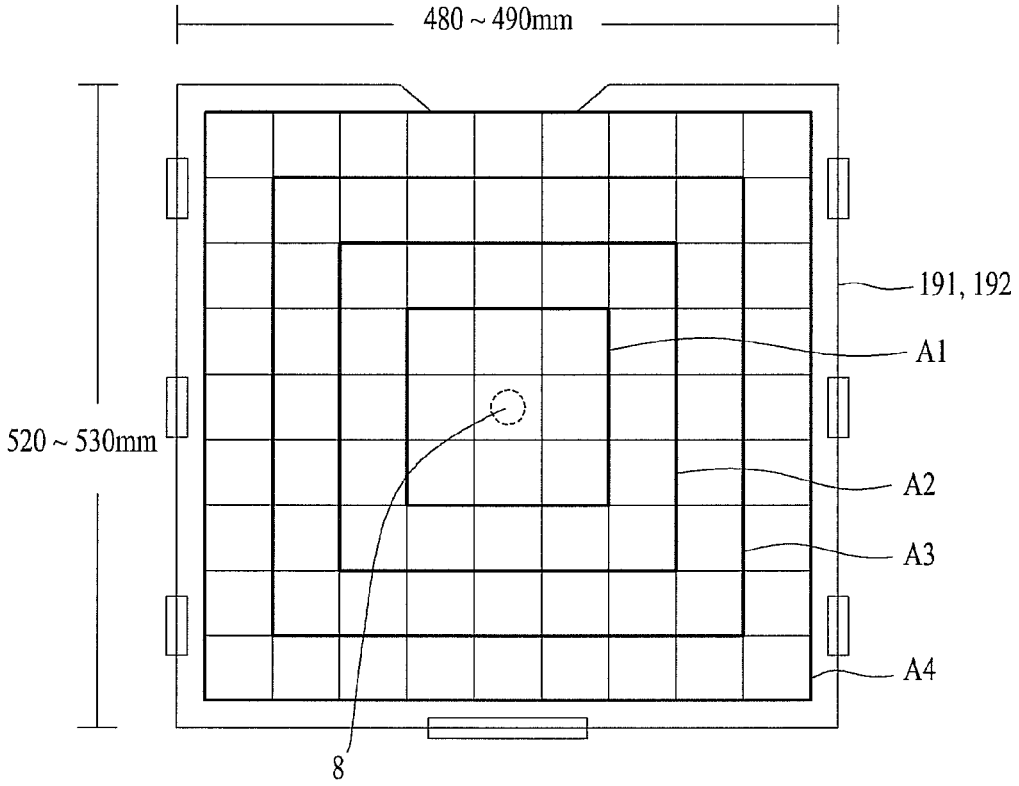
FIGS. 13A-13B and 14A-14B illustrate washing performance test conditions and washing performance test results of the top nozzle.

The one or more holes may include a first hole 838 and a second hole 839. Each hole may be provided in a space defined between two adjacent blades 835 to supply wash water to a lower side of the top nozzle 8. In order to divide an area to which wash water is supplied by the first hole 838 and an area to which wash water is supplied by the second hole 839 from each other, a hole flange 8391 having a predetermined width may be provided at the second hole 839. A distance L1 from the center of rotation NC of the impeller body 831 to the first hole 838 may be greater than a distance L2 from the center of rotation NC of the impeller body 831 to the second hole 839. Consequently, the wash water discharged from the nozzle body 81 through the discharge hole 815 may collide with the plurality of blades 835 to rotate the impeller body 831. During rotation of the impeller body 831, the wash water may be supplied to the lower side of the impeller body 831 through the first hole 838 and the second hole 839. In this case, the second hole 839 may supply wash water to an area A2 outside of an area A1 to which wash water may be supplied by the first hole 838 as shown in FIGS. 13A-13B.

The inclined surface 836 may be provided at the edge of the impeller body 831, such that the inclined surface 836 may be inclined to an upper side of the impeller body 831 at a predetermined angle. In a case in which the inclined surface 831 is inclined to the upper side of the impeller body 831, it may be possible to supply wash water farther from the top nozzle 8. In certain embodiments, one inclined surface 836 may be provided at the edge of the impeller body 831. In alternative embodiments, two inclined surfaces 836 may be provided at the edge of the impeller body 831 as shown in FIG. 12. In the latter case, the two inclined surfaces 836 may be provided at opposite sides of the impeller body 831. The two inclined surfaces 836 may be inclined to the upper side or the lower side of the impeller body 831. Alternatively, one of the inclined surfaces 836 may be inclined toward the upper side of the impeller body 831 and the other inclined surface 836 may be inclined toward the lower side of the impeller body 831.

The bent groove 837 may be provided by bending the edge of the impeller body 831 toward the center of rotation NC of the impeller body 831 to form a concave contour. As a result, the impeller 83 may supply wash water to a space A3 defined between the areas A1 and A2 to which wash water is supplied by the holes 838 and 839 and an area A4 to which wash water is supplied by the inclined surfaces 836.

In the dishwashing machine according to embodiments as broadly described herein, the impeller 83 may be formed asymmetrically, due to the difference in length between the first hole 838 and the second hole 839, and inclination angles of the two or more inclined surfaces 836 and a supply range of the wash water discharged from the discharge hole 815 may be divided based on the asymmetric shape of the impeller 83.

That is, a length of the second hole 839, which may be provided by cutting the impeller body 831 from the shaft through hole 833 to the edge of the impeller body 831, may be different from a length of the first hole 838 due to the hole flange 8391, and thus the supply range A1 of wash water through the first hole 838 may be divided from the supply range A2 of wash water through the second hole 839.

In addition, in a case in which the inclined surfaces 836 are inclined in different directions or the inclined surfaces 836 are inclined in the same direction while having different inclination angles, the area A4 to which wash water is supplied by the inclined surfaces 836 may be divided such that the wash water is supplied to the area A4.

On the other hand, asymmetry of the impeller 83 may be achieved based on a number, position, or size of the bent grooves 837. That is, as shown in FIG. 12, a plurality of bent grooves 837 may be provided at opposite ends of the impeller body 831 along the edge of the impeller body 831 such that the bent grooves 837 may have different sizes to maintain asymmetry of the impeller 83.

In addition, two bent grooves 837 may be provided such that the bent grooves 837 are not opposite each other, or an odd number of bent grooves 837 may be provided asymmetrically along the edge of the impeller body 831 to maintain asymmetry of the impeller 83. In this case, however, sizes of the respective bent grooves 837 (distances from the edge of the impeller body to the respective bent grooves or distances from the shaft through hole to the respective bent grooves) may differ for division into supply ranges of wash water based on the bent grooves 837.

Meanwhile, as shown in FIG. 13A, the rack (the upper rack or the lower rack) may be divided into the area A1 to which wash water may be supplied by the first hole 838, the area A2 to which wash water may be supplied by the second hole 839, the area A3 to which wash water may be supplied by the bent grooves 837, and the area A4 to which wash water may be supplied by the inclined surfaces 836, a volume ratio of which may be about 1:2:3:4. In a case in which the top nozzle 8 is located at the center of the rack, the distances from the center of rotation NC of the impeller body 831 to the holes 838 and 839 and the bent groove 837 may be provided as indicated in a table shown in FIG. 13B.

In a case in which a height of the rack is uniform, a volume ratio of A1 to A4 may be equal to an area ratio of A1 to A4. Consequently, the area ratio of A1 to A4 may be set to 1:2:3:4. Even in a case in which the top nozzle 8 is located at the center of the rack, the distances from the center of rotation NC of the impeller body 831 to the holes 838 and 839 and the bent groove 837 may be provided as indicated in a table shown in FIG. 13B.

In a case in which the rack has a horizontal length of approximately 480 to 490 mm and a vertical length of approximately 520 to 530 mm, therefore, a distance L1 from the center of rotation NC of the impeller body 831 to the first hole 838 may be set to approximately 9 to 10 mm, a distance L2 from the center of rotation NC of the impeller body 831 to the second hole 839 may be set to approximately 10 to 11 mm, and a distance L3 from the center of rotation NC of the impeller body 831 to the bent groove 837 may be set to approximately 19 to 20 mm.

In addition, the inclined surfaces 836 may be inclined at an angle of approximately 5 degrees to the upper side of the impeller body 831 or may be inclined at an angle of approximately 5 degrees to the lower side of the impeller body 831.

Alternatively, one of the inclined surfaces 836 may be inclined at an angle of approximately 5 degrees to the upper side of the impeller body 831 and the other inclined surface 836 may be inclined at an angle of approximately 5 degrees to the lower side of the impeller body 831.

Figure 14A:
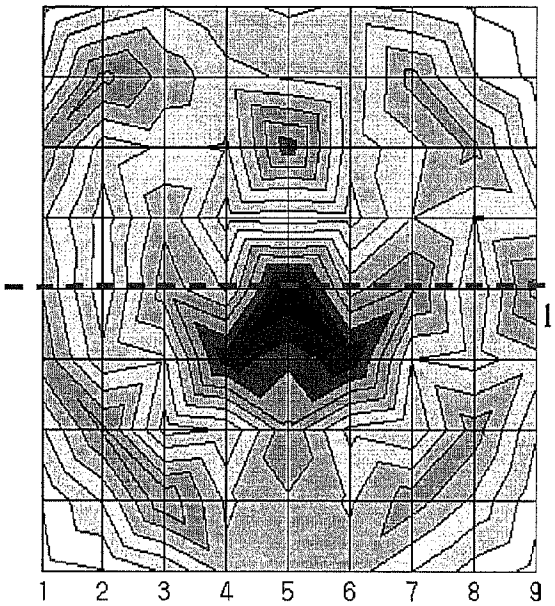
Figure 14B:
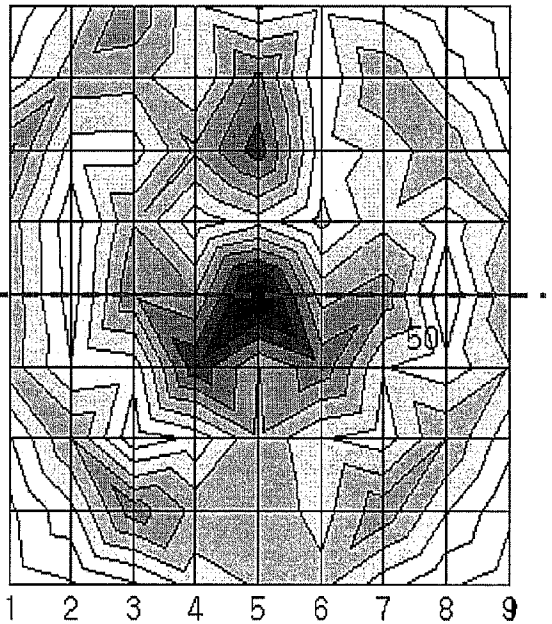

FIG. 14A illustrates performance test results of the top nozzle having the structure as shown in FIG. 11A, and FIG. 14B illustrates performance test results of the top nozzle 8 of the dishwashing machine according to embodiments.

In the washing performance test shown in FIGS. 14A-14B, the rack (the upper rack or the lower rack) is divided into 81 spaces, the dishwashing machine is operated, and amounts of wash water received in the 81 spaces are measured.

The test of FIGS. 14A-14B are performed in a state in which the rack having a horizontal length of approximately 480 to 490 mm, a vertical length of approximately 520 to 530 mm, and a height of approximately 129 to 143 mm is divided into 81 spaces. Numbers in the 81 spaces indicate the amounts of wash water received in the respective spaces. Of the 81 spaces, dark spaces indicate spaces in which less than a reference amount of wash water is received and white spaces indicate spaces in which the reference amount of wash water or more is received.

For the top nozzle configured such that the center of the shaft 818 is aligned with the center of the discharge hole 815 as shown in FIG. 11A (the second channel 23 is disposed at the rear of the rack), a ratio of the amount of wash water supplied to the front of the rack to the amount of wash water supplied to the rear of the rack is 1.27:1. That is, it can be seen from FIG. 14A that for the top nozzle configured such that the center of the shaft 818 is aligned with the center of the discharge hole 815, a larger amount of wash water is supplied to the front of the rack.

For a top nozzle having a rotary arm structure, the amount of wash water supplied inside a radius of rotation of the rotary arm (the amount of wash water supplied to the central part of the rack) is greater than the amount of wash water supplied outside the radius of rotation of the rotary arm (the amount of wash water supplied to the edges of the rack).

However, as shown in FIG. 14B, for the top nozzle having the impeller 83, the number of spaces to which less than the reference amount of wash water is supplied is considerably reduced as compared with the top nozzle having the structure shown in FIG. 11A. Consequently, wash water may be uniformly supplied to substantially the entire area of the rack.

The top nozzle 8 shown in FIGS. 9 to 12 may be applied various different dishwashing machines in addition to the dishwashing machine having the wash water supply system as shown in FIG. 4. For example, the top nozzle 8 shown in FIGS. 9 to 12 may be applied to a dishwashing machine shown in FIG. 15.

Figure 15:
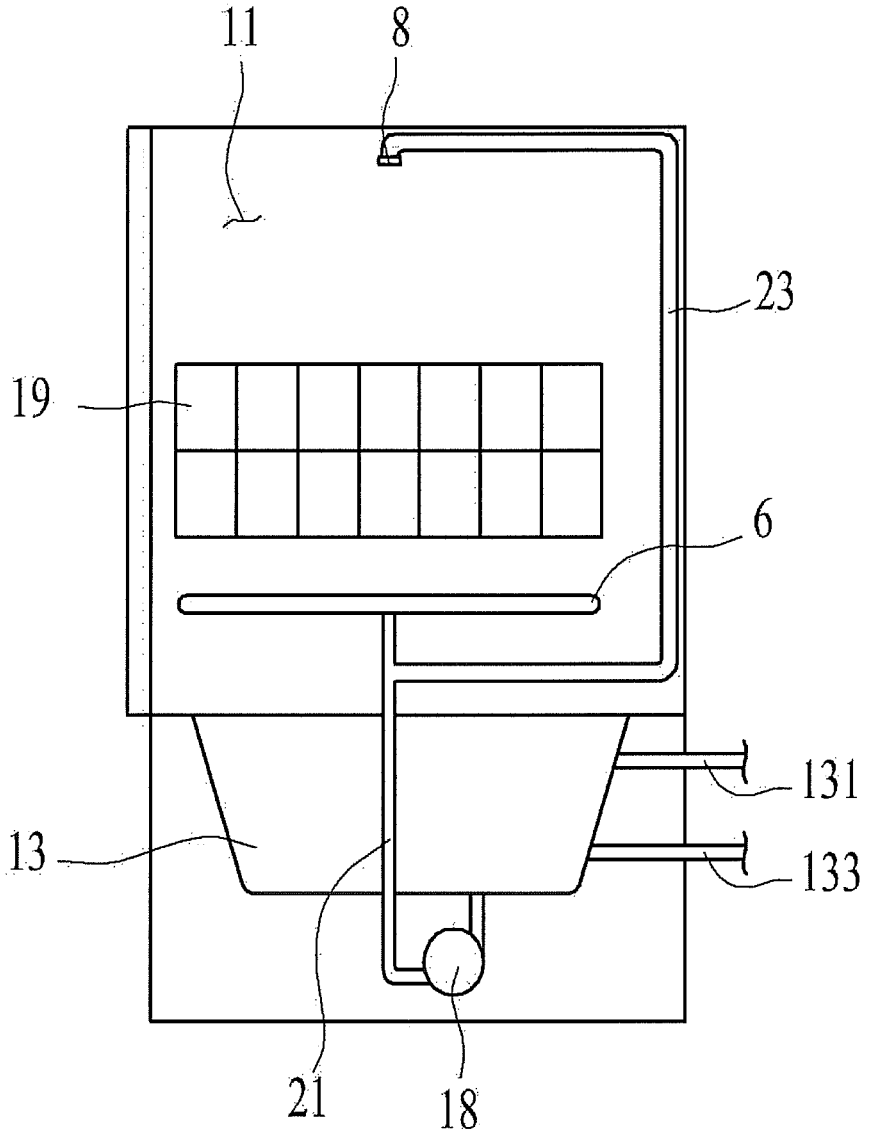
FIG. 15 is a view of another dishwashing machine to which a top nozzle according to an embodiment as broadly described herein is applied.

The dishwashing machine shown in FIG. 15 may include a tub 11 to provide a washing space, a rack 19 provided in the tub 11 to receive objects to be washed, a sump 13 to receive wash water through a sump water supply channel 131 and to discharge wash water through a sump drainage channel 133, a spray arm 6 to spray wash water on to the rack 19 from below the rack 19, and a top nozzle 8 to spray wash water on to the rack 19 from above the rack 19.

In this case, the spray arm 6 receives the wash water stored in the sump 13 through a water supply pump 18 and a first channel 21 and the top nozzle 8 receives wash water through a second channel 23 that diverges from the first channel 21. A valve to alternately open the respective channels 21 and 23 or simultaneously open the respective channels 21 and 23 may be provided at a divergence point between the first channel 21 and the second channel 23. Alternatively, the second channel 23 may be directly connected to the water supply pump 18. The dishwashing machine having the above-stated construction may include the top nozzle 8 shown in FIGS. 9 to 12.

A dishwashing machine is provided that improves washing efficiency and, efficiently utilizes a space of a tub in which objects to be washed are received.

A dishwashing machine is provided that includes a spray arm to spray wash water to a lower rack and a tower nozzle to supply wash water to an upper rack.

A dishwashing machine is provided that supplies wash water to one of a channel to supply the wash water to a spray arm or a channel to supply the wash water to a tower nozzle through a channel change device configured to be rotated depending upon water pressure of the wash water.

A dishwashing machine is provided that includes a top nozzle disposed at an upper side of a rack in which objects to be washed are received to uniformly supply wash water to the objects.

A dishwashing machine as embodied and broadly described herein may include a tub to provide a washing space, a rack disposed in the tub to receive objects to be washed, a water supply pump to supply wash water, and a top nozzle including a nozzle body disposed at an upper side of the rack to receive the wash water from the water supply pump, a discharge hole provided at the nozzle body to discharge the wash water supplied to the nozzle body to the rack, and an asymmetric impeller rotatably provided at the nozzle body to supply the wash water discharged from the discharge hole to at least two divided areas of the rack (at least two different areas of the rack).

The nozzle body may include a shaft provided in the discharge hole such that the shaft is exposed out of the nozzle body. The impeller may include an impeller body having a shaft through hole, through which the shaft may be inserted, and a first hole and a second hole formed through the impeller body, the first hole and the second hole extending from the shaft through hole to an edge of the impeller body. A distance from the shaft through hole to the first hole may be greater than a distance from the shaft through hole to the second hole, such that a supply range of wash water through the first hole may be divided from a supply range of wash water through the second hole.

The impeller may include at least one of a blade that extends from the shaft through hole to the edge of the impeller body in a spiral shape, a bent groove provided by concavely bending the edge of the impeller body toward the shaft through hole, or an inclined surface provided at the edge of the impeller body.

The bent groove may include at least two bent grooves provided at the edge of the impeller body. The respective bent grooves may have different sizes such that a supply range of wash water by one of the bent grooves may be divided from a supply range of wash water by another of the bent grooves.

The inclined surface may include at least two inclined surfaces provided at the edge of the impeller body. one of the inclined surfaces may be inclined at a predetermined angle to an upper side of the impeller body and another of the inclined surfaces may be inclined at a predetermined angle to a lower side of the impeller body.

A dishwashing machine as embodied and broadly described herein may include a tub to provide a washing space, a rack disposed in the tub to receive objects to be washed, a water supply pump to supply wash water, and a top nozzle including a nozzle body disposed at an upper side of the rack to receive the wash water from the water supply pump, a discharge hole provided at the nozzle body to discharge the wash water supplied to the nozzle body to the rack, and an impeller rotatably provided at the nozzle body to scatter the wash water discharged from the discharge hole to at least two different areas of the rack.

The nozzle body may include a shaft inserted through the discharge hole such that the shaft may be located outside the nozzle body and the impeller may be rotatably fixed to the shaft. A center of the shaft may be spaced apart from a center of the discharge hole by a predetermined distance in a direction opposite to a direction in which wash water may be supplied to the nozzle body. The top nozzle may be fixed to a top of the tub and the discharge hole may be spaced apart from the top of the tub corresponding to a center of the rack by a predetermined distance in a direction in which wash water is supplied to the nozzle body.

The impeller may include an impeller body having a shaft through hole, through which the shaft may be inserted and a plurality of blades that extends from the shaft through hole to an edge of the impeller body in a spiral shape. The impeller may further include at least one selected from among a hole formed through the impeller body between one of the plurality of blades and another of the plurality of blades, a bent groove provided by concavely bending the edge of the impeller body toward the shaft through hole, and an inclined surface provided at the edge of the impeller body.

The hole may include a first hole and a second hole provided in a space defined between one of the blades and another of the blades. One of the first hole or the second hole may be further provided with a hole flange connected between one of the plurality of blades and another of the plurality of blades.

The rack may have a horizontal length of approximately 480 to 490 mm and a vertical length of approximately 520 to 530 mm. The top nozzle may be fixed to the top of the tub corresponding to the center of the rack. The first hole may be spaced apart from the shaft through hole by approximately 9 to 10 mm, and the second hole may be spaced apart from the shaft through hole by approximately 10 to 12 mm.

The rack may have a horizontal length of approximately 480 to 490 mm and a vertical length of approximately 520 to 530 mm The top nozzle may be fixed to the top of the tub corresponding to the center of the rack, and the bent groove may be spaced apart from the shaft through hole by approximately 19 to 20 mm.

The inclined surface may be inclined at a predetermined angle to an upper side or a lower side of the impeller body. The inclined surface may include at least two inclined surfaces provided at the edge of the impeller body. One of the inclined surfaces may be inclined to the upper side of the impeller body and another of the inclined surfaces may be inclined to the lower side of the impeller body.

A dishwashing machine as embodied and broadly described herein may include a tub to provide a washing space, an upper rack disposed in the tub to receive objects to be washed, a lower rack disposed at a lower side of the upper rack, a lower arm disposed at a lower side of the lower rack to spray wash water to the lower rack, a rack fixing unit provided at the lower rack, a tower nozzle fixed to the rack fixing unit, such that the tower nozzle extends to the upper rack to spray wash water to the upper rack, a tower connection unit or device configured to be withdrawn from the lower arm depending upon water pressure in the lower arm, the tower connection unit being connected to the tower nozzle to supply wash water to the tower nozzle when the tower connection unit is withdrawn from the lower arm, a top nozzle including a nozzle body disposed at an upper side of the upper rack, a discharge hole provided at the nozzle body to discharge wash water supplied to the nozzle body to the upper rack, and an impeller rotatably provided at the nozzle body to supply the wash water discharged from the discharge hole to at least two different areas of the rack, and a water supply pump to supply wash water to the lower arm and the nozzle body.

The lower arm may include a lower arm chamber to receive wash water through the water supply pump, a removable pipe chamber that communicates with the lower arm chamber via a chamber communication hole to receive the tower connection unit, and an arm channel that communicates with the lower arm chamber via an arm channel communication hole to spray wash water to the lower rack, and a channel change unit or device to alternately open the chamber communication hole and the arm channel communication hole depending upon water pressure in the lower arm chamber may be provided in the lower arm chamber.

The channel change unit may include a change unit body reciprocated and rotated in the lower arm chamber depending upon the water pressure in the lower arm chamber, a chamber opening hole formed through the change unit body to open the chamber communication hole depending upon a rotational angle of the change unit body, and an arm channel opening hole formed through the change unit body to open the arm channel communication hole depending upon the rotational angle of the change unit body.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwashing machine, comprising:

a tub;

at least one rack disposed in the tub;

a water supply pump to supply wash water to the tub; and a top nozzle, including:

a nozzle body provided above the at least one rack;

a nozzle introduction device provided on a side surface of the nozzle body to introduce the wash water from the water supply pump through the nozzle introduction device;

at least one discharge hole provided on a lower surface of the nozzle body;

a shaft provided in the at least one discharge hole, wherein a first end of the shaft is fixed in the nozzle body such that the wash water supplied into the nozzle body flows across the shaft, a second end of the shaft is exposed out of the nozzle body through the at least one discharge hole, and the shaft is spaced apart from a center of the at least one discharge hole by a predetermined distance in a direction in which the wash water is supplied into the nozzle body; and an asymmetric impeller rotatably coupled to the shaft to supply the wash water discharged from the at least one discharge hole to at least two different areas of the at least one rack, wherein the impeller includes an impeller body having at least one hole, and wherein the at least one hole extends through the impeller body from an upper surface thereof to a lower surface thereof.

2. The dishwashing machine of claim 1, wherein a portion of the shaft is exposed out of the nozzle body, wherein the impeller body further includes a shaft through hole, and wherein the shaft is received in the shaft through hole formed in the impeller body.

3. The dishwashing machine of claim 2, wherein the at least one hole includes a first hole and a second hole, wherein the first hole and the second hole extend from the shaft through hole to a corresponding edge of the impeller body, and wherein the impeller further includes at least one of:

at least one blade that extends from the shaft through hole to the edge of the impeller body in a spiral shape;

at least one bent groove provided at the edge of the impeller body, the at least one bent groove including a portion of the edge of the impeller body that is bent toward the shaft through hole; or at least one inclined surface provided at the edge of the impeller body.

4. The dishwashing machine of claim 3, wherein a distance from the shaft through hole to the first hole is greater than a distance from the shaft through hole to the second bole, such that a supply range of the wash water discharged through the first hole is separated from a supply range of the wash water discharged through the second hole.

5. The dishwashing machine of claim 3, wherein the at least one bent groove includes at least two bent grooves provided at the edge of the impeller body, and wherein each of the at least two bent grooves has a different size such that a supply range of the wash water provided by one of the at least two bent grooves is separated from a supply range of the wash water provided by another of the at least two bent grooves.

6. The dishwashing machine of claim 3, wherein the at least one inclined surface includes at least two inclined surfaces provided at the edge of the impeller body, and wherein one of the at least two inclined surfaces is inclined at a predetermined angle toward an upper side of the impeller body and another of the at least two inclined surfaces is inclined at a predetermined angle toward a lower side of the impeller body.

7. The dishwashing machine of claim 1, wherein the top nozzle is fixed to a top interior portion of the tub, and wherein the discharge hole is spaced apart horn the top interior portion of the tub, corresponding to a center of the at least one rack, by a predetermined distance extending in a direction in which the wash water is supplied to the nozzle body.

8. The dishwashing machine of claim 1, wherein the at least one hole includes a first hole having a first predetermined size and a second hole having a second predetermined size different from the first predetermined size.

9. A dishwashing machine, comprising:

a tub that provides a washing space;

at least one rack disposed in the tub;

a water supply pump to supply wash water; and a top nozzle, including:

a nozzle body provided above the at least one rack;

a nozzle introduction device provided on a side surface of the nozzle body to introduce the wash water from the water supply pump through the nozzle introduction device;

at least one discharge hole provided on a lower surface of the nozzle body to discharge the supplied wash water from the nozzle body to the at least one rack;

a shaft provided in the at least one discharge hole, wherein a first end of the shaft is fixed in the nozzle body such that the wash water supplied into the nozzle body flows across the shaft, a second end of the shaft is exposed out of the nozzle body through the at least one discharge hole, and the shaft is spared apart from a center of the at least one discharge hole by a predetermined distance in a direction in which the wash water is supplied into the nozzle body; and an impeller rotatably coupled to the shaft to supply the wash water discharged from the at least one discharge hole to the at least one rack, wherein the impeller includes an impeller body having plurality of holes, and wherein the plurality of holes extends through the impeller body from an upper surface thereof to a lower surface thereof, wherein a hole flange having a predetermined width is provided at at least some of the plurality of holes.

10. The dishwashing machine of claim 9, wherein the impeller further includes:

a shaft through hole provided on the impeller body and configured to receive the shaft; and a plurality of blades that extends from the shaft through hole to an edge of the impeller body in a spiral shape.

11. The dishwashing machine of claim 10, wherein the at least one hole is disposed between adjacent blades of the plurality of blades, and wherein the impeller further includes at least one of:

at least one bent groove provided at the edge of the impeller body, the at least one bent groove being defined by a bend in the edge of the impeller body that extends toward the shaft through hole; or at least one inclined surface provided at the edge of the impeller body.

12. The dishwashing machine of claim 11, wherein the at least one hole includes a first hole and a second hole each provided in a respective space defined between adjacent blades of the plurality of blades.

13. The dishwashing machine of claim 12, wherein one of the first hole or the second hole further includes a hole flange connected between one of the plurality of blades and another of the plurality of blades.

14. The dishwashing machine of claim 11, wherein the at least one inclined surface is inclined at a predetermined angle toward an upper side or a lower side of the impeller body.

15. The dishwashing machine of claim 11, wherein the at least one inclined surface includes at least two inclined surfaces provided at the edge of the impeller body, and wherein one of the at least two inclined surfaces is inclined toward an upper side of the impeller body and another of the at least two inclined surfaces is inclined toward a lower side of the impeller body.

16. The dishwashing machine of claim 9, wherein the top nozzle is fixed to a top of the tub, and wherein the at least one discharge hole is spaced apart from the top of the tub by a predetermined distance in a direction corresponding to a direction in which the wash water is supplied to the nozzle body.

17. A dishwashing machine, comprising:

a tub;

at least one rack received in the tub; and a first nozzle provided in the tub and configured to spray wash water received from a supply pump toward the at least one rack, the first nozzle including:

a nozzle body positioned above the at least one rack, wherein the nozzle body includes a nozzle introduction device provided on a side surface of the nozzle body to receive the wash water through the nozzle body and a shaft provided in at least one discharge hole provided on a lower surface of the nozzle body, wherein a first end of the shaft is fixed in the nozzle body such that the wash water supplied into the nozzle body flows across the shaft, a second end of the shaft is exposed out of the nozzle body through the at least one discharge hole, and the shaft is spaced apart from a center of the at least one discharge hole by a predetermined distance in a direction in which the wash water is supplied into the nozzle body; and an impeller rotatably coupled to the nozzle body, the impeller including:

an impeller body having a shaft through hole in which the shaft of the nozzle body is received to rotatably couple the impeller at the at least one discharge hole provided in the nozzle body;

at least one spiral blade that extends from the shaft through hole to an edge of the body;

a plurality of inclined surfaces that extends at an incline from a corresponding edge portion of the impeller body, wherein at least some of the plurality of inclined surfaces are inclined toward an upper portion of the impeller body, and the rest of the plurality of inclined surfaces are inclined toward a lower portion of the impeller body.

18. The dishwashing machine of claim 17, wherein the first nozzle is provided at a top of the tub, and wherein the impeller is asymmetric such that the wash water sprayed by the first nozzle is dispersed to at least two different areas of the at least one rack.

19. The dishwashing machine of claim 17, wherein the at least one spiral blade includes a plurality of spiral blades that extends radially outward from the shaft through hole, wherein the at least one hole includes first and second holes respectively formed between first and second pairs of adjacent blades of the plurality blades, wherein the at least one bent groove includes first and second bent grooves positioned opposite each other with respect to the shaft through hole, and wherein the at least one inclined surface includes first and second inclined surfaces provided opposite each other with respect to the shaft through hole.

* * * * *